US010712139B2

(12) United States Patent
Heyboer

(10) Patent No.: US 10,712,139 B2
(45) Date of Patent: Jul. 14, 2020

(54) APPARATUS FOR REMOVING SPENT PRIMERS FROM AMMUNITION SHELL CASINGS

(71) Applicant: Mark Heyboer, Grand Rapids, MI (US)

(72) Inventor: Mark Heyboer, Grand Rapids, MI (US)

( * ) Notice: Subject to any disclaimer, the term of this patent is extended or adjusted under 35 U.S.C. 154(b) by 0 days.

(21) Appl. No.: 16/423,693

(22) Filed: May 28, 2019

(65) Prior Publication Data

US 2019/0368849 A1 Dec. 5, 2019

Related U.S. Application Data

(60) Provisional application No. 62/677,251, filed on May 29, 2018.

(51) Int. Cl.
*F42B 33/04* (2006.01)
*F42B 33/00* (2006.01)

(52) U.S. Cl.
CPC ..... *F42B 33/04* (2013.01); *F42B 33/002* (2013.01)

(58) Field of Classification Search
CPC ..... F42B 33/00; F42B 33/06; F42B 33/04; F42B 33/002
USPC ..... 86/12, 21, 24, 49, 36
See application file for complete search history.

(56) References Cited

U.S. PATENT DOCUMENTS 221,563 A 11/1879 Howard
231,162 A * 8/1880 Glover ..... F42B 33/04 86/36
242,775 A * 6/1881 Hobbs ..... F42B 33/04 86/36
269,416 A 12/1882 Hoff
329,135 A * 10/1885 Brown ..... F42B 33/10 86/24
374,482 A 12/1887 Lee
525,065 A * 8/1894 Wright ..... F42B 33/04 86/37
742,768 A * 10/1903 Wetzig ..... F42B 33/04 86/36
1,474,355 A * 11/1923 Fraser ..... F42B 33/001 86/23
1,533,486 A * 4/1925 Welch ..... F42B 33/04 86/49
2,133,198 A * 10/1938 Jayne ..... 86/23
2,325,642 A 8/1943 Turnock et al.
2,398,293 A 4/1946 Dorothea et al.
(Continued)

*Primary Examiner* — Derrick R Morgan

(74) *Attorney, Agent, or Firm* — Barnes & Thornburg, LLP

(57) ABSTRACT

An apparatus for removing spent primers from spent ammunition shell casings includes a body defining a feed channel, a pin plunger channel intersecting the feed channel at a punch zone configured to receive a shell casing therein, and a guide channel intersecting the pin plunger channel, a pin plunger movable along the pin plunger channel and defining a punch end, a guide member movable along the guide channel, and a handle assembly coupled to the pin plunger and the guide member such that rotary motion of the handle assembly drives the pin plunger along the pin plunger channel toward and into the punch zone so that, with a spent shell casing positioned in the punch zone, the punch end of the pin plunger extends into and drives the spent primer from the spent shell casing.

20 Claims, 13 Drawing Sheets

(56) References Cited

U.S. PATENT DOCUMENTS 2,748,648 A * 6/1956 Miller ..... F42B 33/10 86/36
3,049,044 A * 8/1962 English ..... F42B 33/02 86/24
3,107,575 A 10/1963 Paul
3,349,663 A * 10/1967 Slee ..... F42B 33/04 86/38
3,636,812 A * 1/1972 Nuler ..... F42B 33/04 86/33
3,693,497 A * 9/1972 Jacobitz ..... B21D 1/08 86/28
3,973,465 A 8/1976 Bachhuber et al.
3,982,465 A * 9/1976 Schabauer ..... F42B 33/10 86/36
4,188,855 A * 2/1980 Alberts ..... F42B 33/04 86/23
4,475,435 A 10/1984 Mantel
4,512,235 A * 4/1985 Lee ..... F42B 33/10 86/23
4,593,598 A * 6/1986 Gunder ..... F42B 33/10 72/352
4,630,341 A 12/1986 Rohmer et al.
5,198,606 A 3/1993 Storstad et al.
5,204,488 A 4/1993 Cimolino et al.
5,341,717 A * 8/1994 Feldman ..... F42B 33/04 269/37
5,435,223 A 7/1995 Blodgett et al.
5,515,766 A * 5/1996 Fleury ..... F42B 33/10 72/90
6,260,463 B1 * 7/2001 Brand ..... F42B 33/04 86/24
9,182,203 B2 11/2015 Mirza
9,846,018 B1 12/2017 Schloer
2015/0198429 A1 * 7/2015 Mirza ..... F42B 33/04 86/37
2016/0076864 A1 * 3/2016 Dykstra ..... F42B 33/04 86/36
2018/0335287 A1 * 11/2018 Tomasoni ..... F42B 33/002
2019/0219374 A1 * 7/2019 Cauley, Jr. ..... F42B 33/10

* cited by examiner

APPARATUS FOR REMOVING SPENT PRIMERS FROM AMMUNITION SHELL CASINGS

CROSS-REFERENCE TO RELATED APPLICATION

This patent application claims the benefit of and priority to U.S. Provisional Patent Application Ser. No. 62/677,251, filed May 29, 2018, the disclosure of which is expressly incorporated herein by reference in its entirety.

FIELD OF THE DISCLOSURE

This disclosure relates generally to ammunition reloading apparatuses, and more specifically to apparatuses for removing spent primers from ammunition shell casings prior to or as part of an ammunition reloading process.

BACKGROUND

Conventional ammunition reloading apparatuses replace spent primers in spent shell casings with new primers as part of the overall reloading process. As this reloading process is typically carried out as a single-stage process, there is generally no opportunity with such conventional apparatuses to inspect or clean the primer bore after removal of the spent primer. As conventional primers are by their nature incendiary devices, firing of such primers typically results in deposition of powder residue, e.g., carbon, on and around the primer bores of spent shell casings.

If not cleaned prior to reloading the spent shell casing, such residue can potentially cause improper seating of reloaded primers which can lead to increased misfire rates with reloaded shell casings as compared with OEM shell casings. As such, it is desirable to remove spent primers from spent ammunition shell casings to allow complete cleaning of the case, including the primer bore, prior to any subsequent reloading operations.

SUMMARY

The present disclosure may comprise one or more of the features recited in the attached claims, and/or one or more of the following features and combinations thereof. In one aspect, an apparatus for removing spent primers from spent ammunition shell casings may comprise a main body defining therein an elongated shell casing feed channel, an elongated pin plunger channel intersecting the shell casing feed channel at a punch zone configured to receive a spent ammunition shell casing, carrying a spent primer, fed thereto along the shell casing feed channel, and an elongated guide channel also intersecting the pin plunger channel, a pin plunger, having a punch end, received within the pin plunger channel and configured to be movable along the pin plunger channel such that the punch end extends into the punch zone of the shell casing feed channel, a guide member received within the guide channel and configured to be movable along the guide channel, and a handle assembly operatively coupled to the pin plunger and to the guide member such that rotary motion of the handle assembly about a rotational axis extending perpendicularly through an intersection of the pin plunger channel and the guide channel drives the pin plunger along the pin plunger channel toward and into the punch zone so that, with a spent ammunition shell casing positioned in the punch zone, the punch end of the pin plunger extends into an open end of the shell casing and drives the spent primer from the spent shell casing.

In another aspect, an apparatus for removing spent primers from spent ammunition shell casings may comprise a main body defining therein an elongated shell casing feed channel and an elongated pin plunger channel intersecting the shell casing feed channel at a punch zone configured to receive a spent ammunition shell casing, carrying a spent primer, fed thereto along the shell casing feed channel, a pin plunger, having a punch end, received within the pin plunger channel and configured to be movable along the pin plunger channel such that the punch end extends into the punch zone of the shell casing feed channel, a shell casing feed plunger received within the guide channel and configured to be movable along the guide channel, and a rotary motion handle assembly operatively coupled to the pin plunger and to the shell casing feed plunger such that rotary motion of the handle assembly drives the shell casing feed plunger along the shell casing feed channel to feed a spent ammunition shell casing into the punch zone and to drive pin plunger along the pin plunger channel toward and into the punch zone so that, with a spent ammunition shell casing positioned in the punch zone, the punch end of the pin plunger extends into an open end of the shell casing and drives the spent primer from the shell casing.

In yet another aspect, an apparatus for removing spent primers from spent ammunition shell casings may comprise a main body defining therein an elongated shell casing feed channel and an elongated pin plunger channel intersecting the shell casing feed channel at a punch zone configured to receive a spent ammunition shell casing, carrying a spent primer, fed thereto along the shell casing feed channel, a pin plunger, having a punch end, received within the pin plunger channel and configured to be movable along the pin plunger channel such that the punch end extends into the punch zone of the shell casing feed channel, a shell casing feed plunger received within the guide channel and configured to be movable along the guide channel, and a rotary motion handle assembly operatively coupled to the pin plunger and to the shell casing feed plunger, wherein one complete rotation of the handle assembly drives, in sequence, (i) the shell casing feed plunger along the shell casing feed channel to feed a spent ammunition shell casing in the shell casing feed channel into the punch zone, (ii) the pin plunger along the pin plunger channel toward and into the punch zone so that, with the spent ammunition shell casing positioned in the punch zone, the punch end of the pin plunger extends into an open end of the shell casing and drives the spent primer from the shell casing, (iii) the spent shell casing and the spent primer from the main body via respective outlet ports defined in the shell casing feed channel, and (iv) the shell casing feed plunger to a return position which feeds another ammunition shell casing into the shell casing feed channel.

BRIEF DESCRIPTION OF THE DRAWINGS

This disclosure is illustrated by way of example and not by way of limitation in the accompanying Figures. Where considered appropriate, reference labels have been repeated among the Figures to indicate corresponding or analogous elements.

DETAILED DESCRIPTION OF THE DRAWINGS

Figure 1:
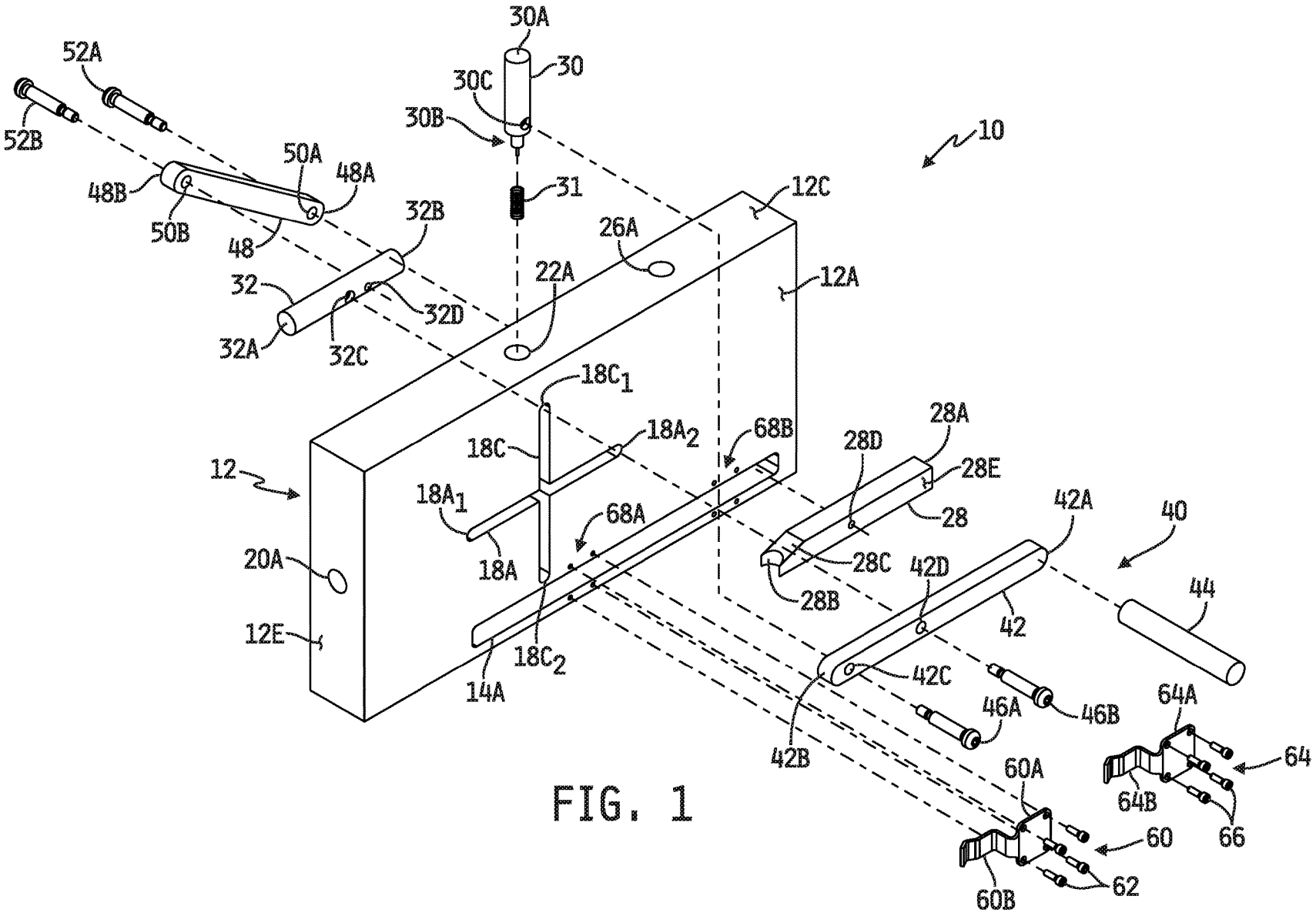
FIG. 1 is an exploded perspective view of an embodiment of an apparatus for removing spent primers from ammunition shell casings.
Figure 2:
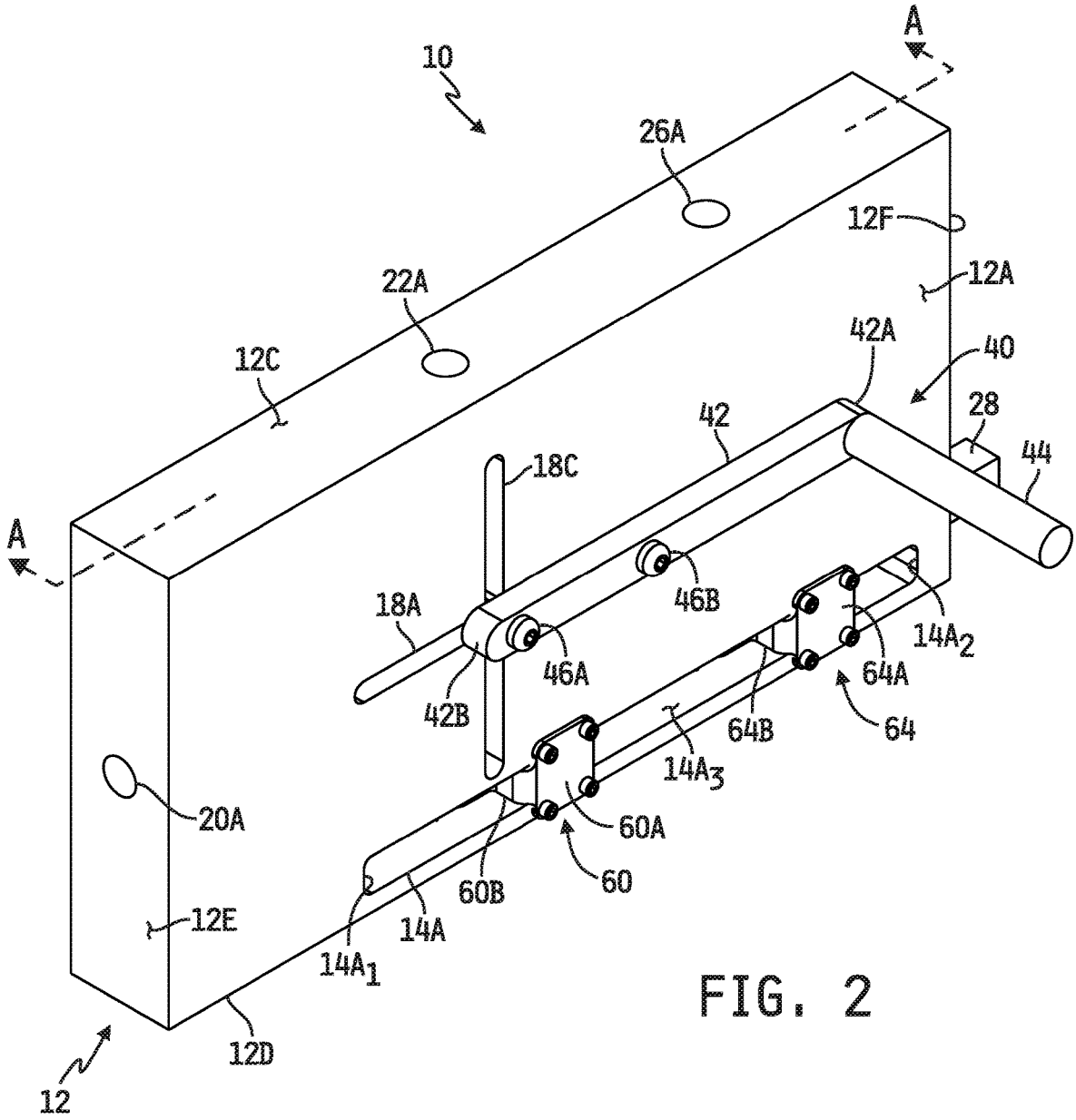
FIG. 2 is perspective view of the apparatus of FIG. 1 viewed from the same perspective as FIG. 1 and showing the apparatus as assembled.

While the concepts of the present disclosure are susceptible to various modifications and alternative forms, specific exemplary embodiments thereof have been shown by way of example in the drawing and will herein be described in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases may or may not necessarily refer to the same embodiment. Further, when a particular feature, structure or characteristic is described in connection with an embodiment, it is submitted that it is within the knowledge of one skilled in the art to effect such feature, structure or characteristic in connection with other embodiments whether or not explicitly described. Further still, it is contemplated that any single feature, structure or characteristic disclosed herein may be combined with any one or more other disclosed feature, structure or characteristic, whether or not explicitly described, and that no limitations on the types and/or number of such combinations should therefore be inferred.

The present disclosure is directed to a manually-operated apparatus for removing spent primers from ammunition shell casings. As will be described in detail below, the apparatus includes a rotatable handle which, upon manual rotation thereof, drives advancement of a pre-oriented ammunition shell casing having a spent primer along a shell casing feed channel toward and into alignment with a pin plunger, and then drives the pin plunger into the shell casing toward and into the spent primer to punch the spent primer out of the shell casing. In some embodiments, the apparatus may be configured hold multiple oriented ammunition shell casings in a shell casing inlet channel such that continuous manual rotation of the rotatable handle continually advances the ammunition shell casings, one-at-a-time, from the shell casing inlet channel into the shell casing feed channel where they are driven, one-at-a-time, by rotatory motion of the handle toward and into alignment with the pin plunger for removal of the spent primer by the rotatable handle-driven pin plunger. Alternatively or additionally, ammunition shell casings may be continually fed from an external shell casing feed device into the shell casing inlet channel as the apparatus processes the shell casings, one-at-a-time, via manual rotation of the rotatable handle.

Referring to FIGS. 1-4B, an embodiment is shown of an apparatus 10 for removing spent primers from ammunition shell casings. In one embodiment, most, if not all, of the components making up the apparatus 10 are machined from a conventional stainless steel, e.g., type 304 or 316 steel, or other suitable material, although one or more of the components may be otherwise formed of one or more suitable alternate materials and/or using one or more other suitable fabrication techniques such as casting, stamping, molding, setting, curing or the like. In any case, the apparatus 10 includes a main body 12 illustratively formed in the shape of a rectangle, although it will be understood that other shapes of the main body 12 are contemplated by this disclosure. In the illustrated embodiment, the rectangular main body 12 includes a planar front major surface 12A, a planar rear or back major surface 12B opposite the front major surface 12A, opposing top and bottom planar surfaces 12C, 12D respectively extending between the front and back surfaces 12A, 12B, and opposing planar side surfaces 12E, 12F extending between the front and back surfaces 12A, 12B and between the top and bottom surfaces 12C, 12D.

The main body 12 illustratively defines a plurality of channels therein each sized and configured to slidingly receive a corresponding one of a plurality of plungers. The main body 12 further defines a number of slots therein each of which extend from an exterior surface of the main body 12 into a corresponding one of the plurality of channels. For example, the front surface 12A defines therein an elongated slot 14A which extends into an elongated channel 16 defined in the main body 12. The elongated channel 16 has an opening 16A at one end thereof, which is open to the side 12F of the main body 12, and extends linearly into the body 12 toward the opposite side 12E and terminates at an end 16B of the channel 16 which is spaced apart from the side 12E. The elongated channel 16 illustratively extends into the main body 12 from the open end 16A thereof in a direction parallel with the planar top and bottom surfaces 12C, 12D. The elongated channel 16 has another opening 16C adjacent to the terminal end 16B which is extends from the floor 16D of the channel 16 to and through the bottom 12D of the body 12.

The slot 14A is illustratively aligned with the channel 16 and extends from the outer surface 12A of the main body 12 into the channel 16. One end 14$A_1$ of the slot 14 illustratively terminates coextensively with the terminal end 16B of the channel 16, and the opposite end 14$A_2$ of the slot 14 terminates short of the side 12F such that the terminal end 14$A_2$ of the slot 14A is spaced apart from the side 12F of the main body 12. The elongated slot 14A thus extends along the main body 12 in a direction parallel with the planar top and bottom surfaces 12C, 12D, and is open to both the channel 16 and the outer surface of the side 12A of the main body. In the illustrated embodiment, the slot 14A and the channel 16 have the same height such that the floor 16D of the channel 16 is coextensive with the floor 14$A_3$ of the slot 14A and the ceiling of the channel 16 is coextensive with the ceiling of the slot 14A. In alternate embodiments, the heights of the slot 14 and of the channel 16 may be different such that the floor 16D of the channel 16 is not coextensive with the floor 14$A_3$ of the slot 14A and/or such that the ceiling of the channel 16 is not coextensive with the ceiling of the slot 14A.

Figure 3:
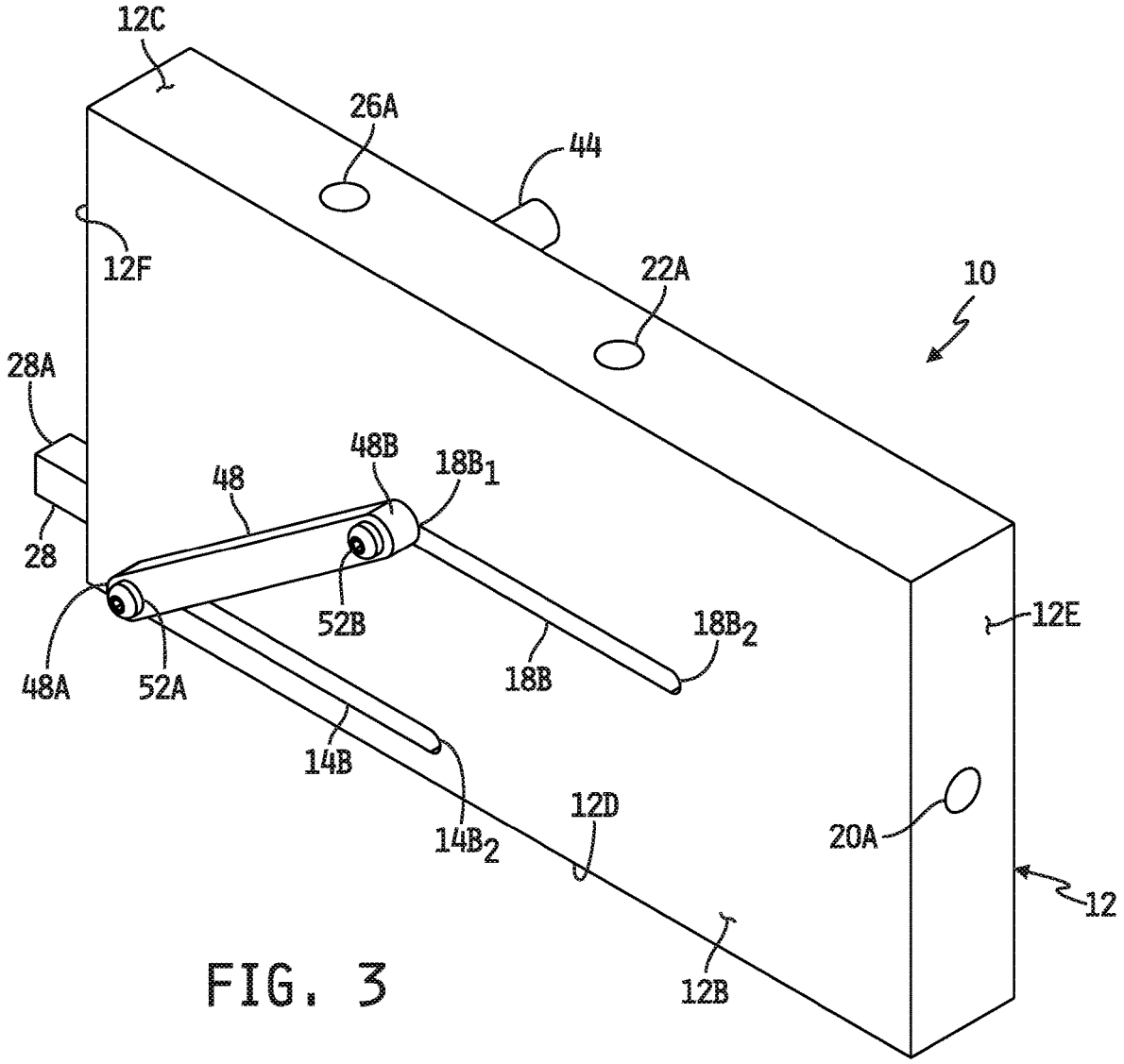
FIG. 3 is a perspective view of the assembled apparatus of FIG. 2 as viewed from an opposite side of the apparatus.

The rear surface 12B of the main body 12 likewise defines therein an elongated slot 14B which also extends into the elongated channel 16 as illustrated in FIG. 3. The slot 14B has a terminal end 14$B_1$ which is spaced apart from the side 12F of the main body 12 (see, e.g., FIG. 6A) and an opposite terminal end 14$B_2$ which is approximately coextensive with the midpoint of the channel 16 (see, e.g., FIG. 4A). The elongated slot 14B extends along the main body 12 in a direction parallel with the planar top and bottom surfaces 12C, 12D, and is aligned with and open to both the channel 16 and the outer surface of the side 12B of the main body. Illustratively, the height of the slot 14B is less than that of the channel 16, and the shorter height of the slot 14B illustratively bisects the greater height of the channel 16.

The main body 12 defines another elongated channel 20 therein which illustratively extends linearly into the main body 12 in a direction parallel with the channel 16 such that the elongated channel 20 is positioned between the channel 16 and the planar top 12C of the main body 12. The elongated channel 20 has an opening 20A at one end thereof, which is open to the side 12E of the main body 12, and extends linearly into the body 12 toward the opposite side 12F and terminates at an end 20B of the channel 16 which is spaced apart from the side 12F.

The front surface 12A of the main body 12 defines therein another elongated slot 18A which is aligned with the elongated channel 20 and extends from the outer surface 12A of the main body 12 into the elongated channel 20. One terminal end 18$A_1$ of the slot 14 is spaced apart from the side 12E of the main body 12, and the opposite terminal end 18$A_2$ is spaced apart from the side 12F of the main body 12. The elongated slot 18A thus extends along the main body 12 in a direction parallel with the planar top and bottom surfaces 12C, 12D, and is open to both the channel 20 and the outer surface of the side 12A of the main body. Illustratively, the height of the slot 18A is less than that of the channel 20, and the shorter height of the slot 18A illustratively bisects the greater height of the channel 20.

The rear surface 12B of the main body 12 likewise defines therein an elongated slot 18B which also extends into the elongated channel 20 as illustrated in FIG. 3. The slot 18B has a terminal end 18$B_1$ which is spaced apart from the side 12F of the main body 12 and an opposite terminal end 18$B_2$ which is spaced apart from the side 12E of the main body 12. The elongated slot 18B extends along the main body 12 in a direction parallel with the planar top and bottom surfaces 12C, 12D, and is aligned with and open to both the channel 20 and the outer surface of the side 12B of the main body 12. Illustratively, the height of the slot 18B is less than that of the channel 20, and the shorter height of the slot 18B illustratively bisects the greater height of the channel 20. The slots 18A and 18B are thus aligned with one another and bisect the channel 20 on opposite sides 12A, 12B respectively of the main body 12.

The main body 12 defines yet another elongated channel 22 therein which illustratively extends linearly into the main body 12 in a direction parallel with the sides 12E, 12F of the main body 12 and perpendicular to the channels 16 and 20. The elongated channel 22 has an opening 22A at one end thereof, which is open to the top 12C of the main body 12, and extends linearly into the body 12 toward the bottom 12D, through the channel 22, and terminates at an end 22B of the channel 22 which is open to the channel 16. The channel 22 thus intersects and passes through the channel 20, and also intersects and opens to the channel 16. Another channel 24 is axially aligned with the channel 22 and extends from an opening 24A in the floor 16D of the channel 16 to an opening 24B in the bottom 12D of the main body 12. The channel 24 thus defines a passageway from the channel 16 to and out of the bottom 12D of the main body 12 and, as will be described in detail below, provides a spent primer exit channel through which extracted spent primers exit the apparatus 10.

The front surface 12A of the main body 12 defines therein another elongated slot 18C which is aligned with the elongated channel 22 and extends from the outer surface 12A of the main body 12 into the elongated channel 22. One terminal end 18$C_1$ of the slot 18C is spaced apart from the top 12C of the main body 12, and the opposite terminal end 18$C_2$ terminates above the slot 14A. Between the opposite terminal ends 18$C_1$ and 18$C_2$, the elongated slot 18C passes through and illustratively bisects the elongated slot 18 as it extends along the main body 12 in a direction perpendicular to the slots 14A and 18A. The slot 18C is open to both the channel 22 and the outer surface of the side 12A of the main body. Illustratively, the width of the slot 18A is less than that of the channel 22, and the shorter width of the slot 18C illustratively bisects the greater width of the channel 22.

Figure 4A:
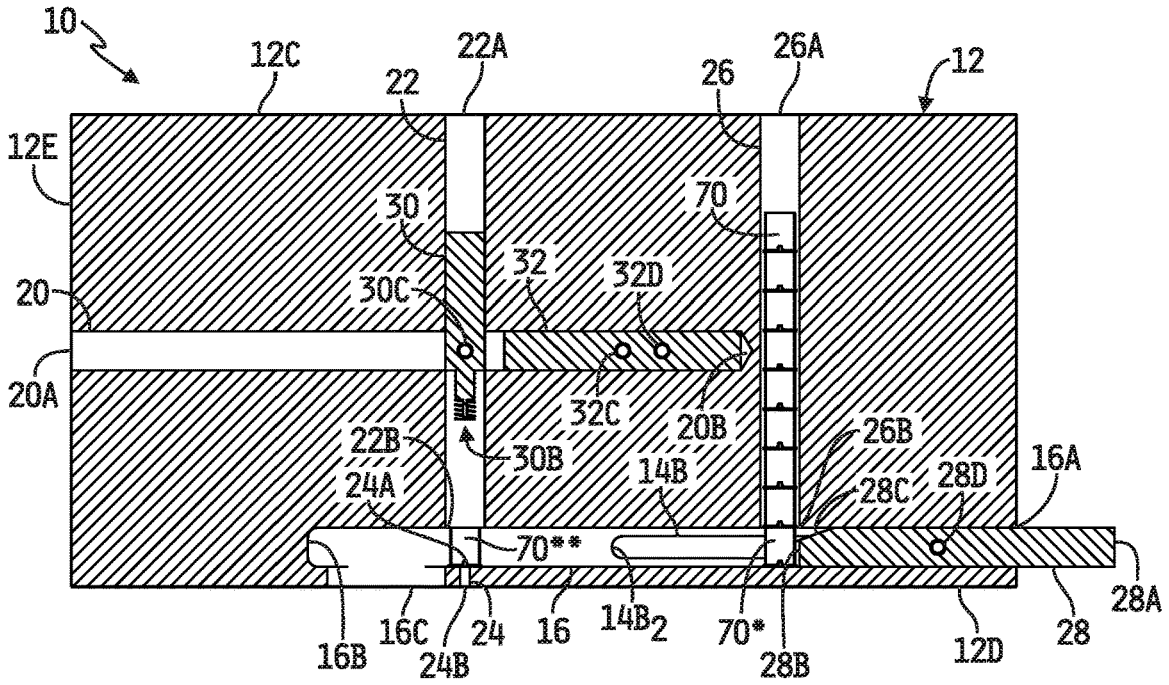
FIG. 4A is a cross-sectional view of the apparatus of FIGS. 1-3 as viewed along the section lines A-A of FIG. 2 showing operation of the apparatus with the rotatable handle member in a first position.
Figure 4B:
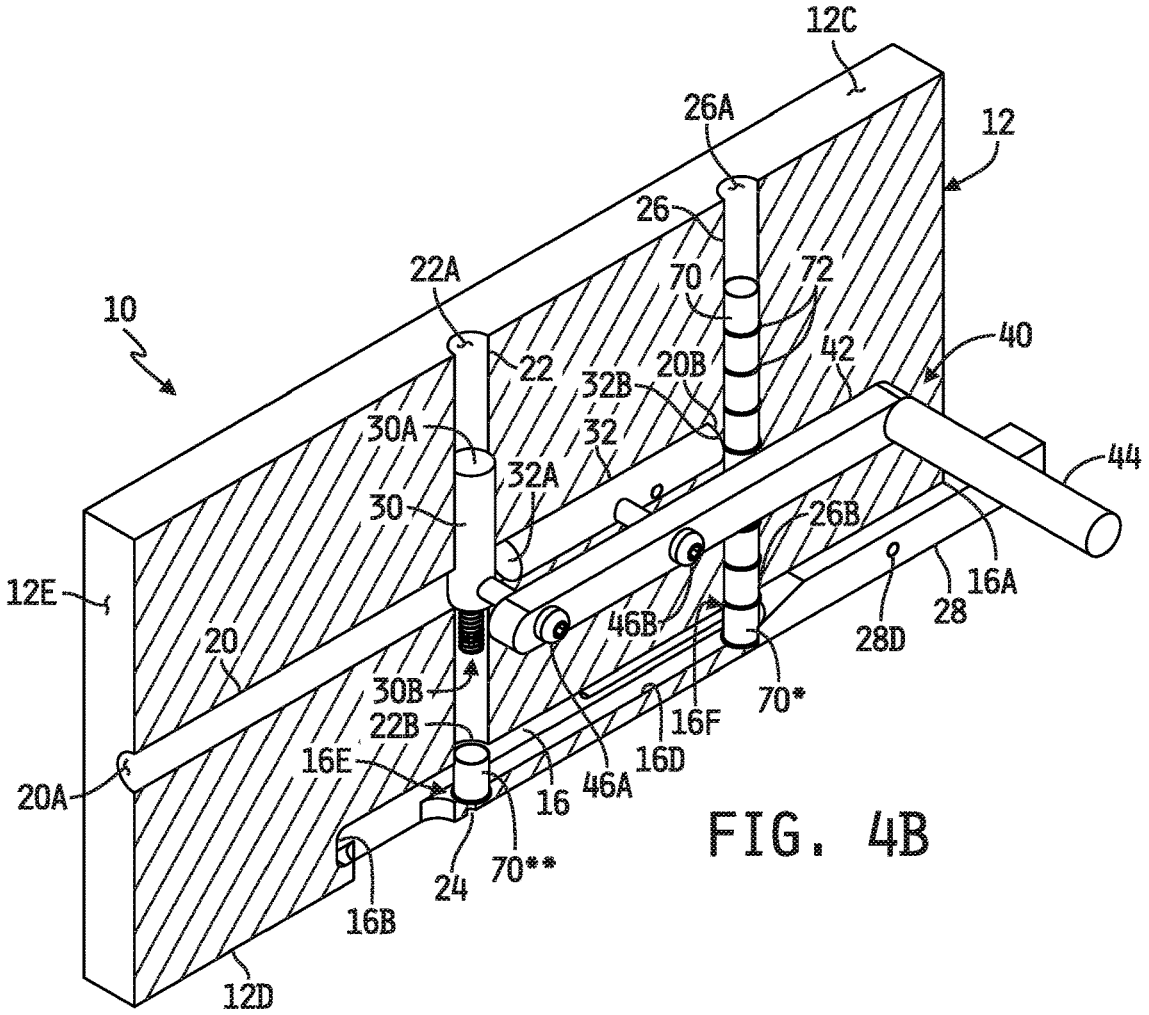
FIG. 4B is a cutaway perspective view of the apparatus of FIGS. 1-3 viewed from the same perspective view as FIG. 2 but with a portion of the main body removed along the section lines A-A of FIG. 2, showing operation of the apparatus in the same state as that illustrated in FIG. 4A with the handle member in the first position.

The main body 12 defines still another elongated channel 26 therein which illustratively extends linearly into the main body 12 in a direction parallel with the channel 22 and with the sides 12E, 12F of the main body 12 and perpendicular to the channels 16 and 20. The elongated channel 26 has an opening 26A at one end thereof, which is open to the top 12C of the main body 12, and extends linearly into the body 12 toward the bottom 12D and terminates at an end 26B of the channel 22 which is open to the channel 16. The channel 26 is positioned between the side 12F of the main body 12 and the terminal end 20B of the channel 20 but does not intersect the channel 20. The channel 26 is open to both the top 12C of the main body 12 and the channel 16, and is sized and configured to receive oriented ammunition shell casings 70 therein as illustrated in FIGS. 4A and 4B and to feed such shell casings 70 to the channel 16. In this regard, the channel 26 is referred to herein as a shell casing inlet channel.

An elongated shell casing feed plunger 28 is sized to be slidably received within the channel 16. When in the channel 16, one end 28A of the plunger 28 is oriented toward the opening 16A of the channel at the side 12F of the main body 12 and an opposite "nose" end 28B is oriented toward the terminal end 16B of the channel 16. The nose end 28B of the plunger 28 is illustratively formed in a convex arcuate shape with the convex surface of the arcuate shape configured and sized to radially engage an exterior radial surface of an oriented ammunition shell casing 70* which has entered the channel 16. In one embodiment, the arcuate-shaped convex surface of the nose end 28B of the plunger 28 is sized complementarily to the radial circumference of the shell casing 70*, although in other embodiments the arcuate-shaped convex surface of the nose end 28B may be smaller or larger than the radial circumference of the shell casing 70*. In one such alternate embodiment, the arcuate-shaped convex surface of the nose end 28B of the plunger 28 may be sized complementarily to the radial circumference of a largest diameter shell casing 70* to be processed by the apparatus 10. In other alternate embodiments, the apparatus 10 may include multiple different plungers 28 each having a nose end 28B with a different radius, each sized for an outer diameter of a specific caliber shell casing 70*, and in such embodiments the plunger 28 may be selected and installed to process a specific corresponding shell casing 70*.

Adjacent to the nose 28B, the top surface of the plunger 28 has a sloped region 28C which serves to guide ammunition shell casings 70 from the shell casing inlet channel 26 into the channel 16 as will be described in greater detail below. A bore 28D is defined transversely through the plunger 28 between the two ends 28A, 28B, and an exterior side surface 28E of the plunger 28 is exposed through the channel 14A when the plunger 28 is received within the channel 16. As will be described in detail below, the shell casing feed plunger 28 is guided back and forth through the channel 16 for the purpose of feeding oriented ammunition shell casings 70 one-at-a-time from the shell casing inlet channel 26 into the channel 16, and for the purpose of feeding ammunition shell casings 70* in the channel 16 toward the intersection of the channel 16 with the channel 22. The channel 16 is thus referred to herein as a shell casing feed channel 16.

An elongated pin plunger 30 is sized to be slidably received within the channel 22, and in this regard the channel 22 is referred to herein as a pin plunger channel 22. When in the channel 22, one end 30A of the plunger 28 is oriented toward the opening 22A of the channel 22 at the top 12C of the main body 12 and an opposite "punch" end 30B is oriented toward the shell casing feed channel 16. The punch end 30B of the plunger 28 is sized and configured to be driven along the pin plunger channel 22 and into a shell casing 70 positioned in a punch zone 16E of the shell casing feed channel 16 (see, e.g., FIG. 4B). The "punch zone" 16E of the shell casing feed channel 16 is defined for purposes of this disclosure as the portion of the shell casing feed channel 16 which intersects and is aligned with the channel 22 such that when an oriented shell casing 70** is positioned within the punch zone 16E the oriented shell casing 70** is axially and centrally aligned with the punch end 30B of the pin plunger 30. In this regard, the shell casing designation 70** is used to identify a shell casing 70 that is positioned in the punch zone 16E of the shell casing feed channel 16. In any case, a bore 30C is defined transversely through the pin plunger 30 between the two ends 30A, 30B. As will be described in detail below, the pin plunger 30 is guided back and forth through the pin plunger channel 22 for the purpose of punching out spent primers from oriented ammunition shell casings 70** positioned in the punch zone 16E of the channel 16**.

An elongated internal guide member 32 is sized to be slidably received within the channel 20, and in this regard the channel 20 is referred to herein as a guide channel 20. When in the guide channel 20, one end 32A of the guide member 32 is oriented toward the open end 20A of the guide channel 20 at the side 12E of the main body 12 and an opposite end 32B is oriented toward the terminal end 20B of the guide channel 20. Two bores 32C, 32D are defined transversely through the pin guide member 32 between the two ends 32A, 32B. As will be described in detail below, the guide member 32 is guided back and forth through the guide channel 20 by a rotatable handle 40 for the purpose of translating rotational motion of the handle 40 to a linear drive motion for guiding and driving of the pin plunger 30 along the pin plunger channel 22.

A rotatable handle 40 includes an elongated handle shaft 42 having opposing ends 42A, 42B. Bores 42C, 42D are defined transversely through the handle shaft 42. The bore 42C is adjacent to the end 42A of the handle shaft 42 and the bore 42D is spaced apart from the bore 42C such that the bore 42D is positioned between the bore 42C and the end 42B of the handle shaft 42. An elongated handle grip 44 is axially attached at or near the end 42B of the handle shaft 42, and the handle grip 44 illustratively has a length sized to accommodate a width of a human hand so as to provide for manual, hand-driven operation of the rotatable handle 40. The handle shaft 42 and the handle grip 44 reside externally to the main body 12, and the handle shaft 42 is attached or mounted to components within the main body 12 as described below.

A fixation member 46A, e.g., a threaded screw or bolt or other conventional fixation member, extends through the bore 42C of the handle shaft 42, through the slot 18C defined in the main body 12 and into engagement with the bore 30C of the pin plunger 30. Another fixation member 46B, e.g., a threaded screw or bolt or other conventional fixation member, extends through the bore 42D of the handle shaft 42, through the slot 18A defined in the main body 12 and into engagement with the bore 32D of the guide member 32. As illustrated sequentially in FIGS. 4B, 5B, 6B and 7B, clockwise rotational motion of the handle shaft 42, driven manually via the handle grip 44, is captured statically at 3 o'clock, 6 o'clock, 9 o'clock and 12 o'clock positions respectively. Such clockwise rotational motion of the handle shaft 42 linearly guides the fixation member 46A along the slot 18C defined through the main body 12 to thereby linearly drive the pin plunger 30 up and down along the pin plunger channel 33, and likewise linearly guides the fixation member 46B along the slot 18A defined through the main body 12 to thereby linearly drive the guide member 32 back and forth along the guide channel 20. Illustratively, the lengths of the pin plunger 30 and the guide member 32, the positions of the bores 30C and 32C of the pin plunger 30 and the guide member 32 respectively, and the spacing between the bores 42C, 42D of the handle shaft 42 are all selected such that the fixation members 46A, 46B alternatingly align with one or the other of the channels 20, 22, and the fixation members 46A, 46B also alternatingly align with centrally with the axial intersection 21 of the guide channel 20 and the pin plunger channel 22. Accordingly, the axis of rotation of the rotatable handle 40, i.e., of the handle shaft 42, is the axial intersection 21 of the channels 20, 22 (see, e.g., FIG. 5B). In alternate embodiments, the various components of the apparatus 10 may be configured and arranged such that the rotatable handle 40 is rotated counter-clockwise to process spend shell casings 70.

As illustrated in FIGS. 1 and 3, an elongated external guide member 48 has opposing ends 48A, 48B, and bores 50A, 50B are defined transversely through the guide member 48. The bore 50A is at or adjacent to the end 48A of the guide member 48 and the bore 50B is at or adjacent to the end 48B of the guide member 48. Like the rotatable handle 40, the external guide member 48 resides externally to the main body 12. A fixation member 52A, e.g., a threaded screw or bolt or other conventional fixation member, extends through the bore 50A of the guide member 48, through the slot 14B defined in the main body 12 and into engagement with the bore 28D of the shell casing feed plunger 28. Another fixation member 46B, e.g., a threaded screw or bolt or other conventional fixation member, extends through the bore 50B of the guide member 48, through the slot 18B defined in the main body 12 and into engagement with the bore 30C of the pin plunger 30.

As rotational motion of the handle shaft 42 guides the fixation member 46B linearly along the slot 18A and thereby drives the internal guide member 32 back and forth along the guide channel 20 as described above, the internal guide member 32 coupled to the guide member 32 by the fixation member 52B, in turn, drives the fixation member 52B linearly along the slot 18B defined in the main body 12 opposite the slot 18A. As the fixation member 52B is driven linearly along the slot 18B, the external guide member 48 guides the fixation member 52A linearly along the slot 14B defined in the main body 12, thereby driving the shell casing feed plunger 28 back and forth along the shell casing guide channel 16. Illustratively, the length of the shell casing feed plunger 28, the positions of the bores 28D, 32D relative to the guide member 32 and plunger 28 respectively, the length of the guide member 48 and the lengths and positions of the slots 14B, 18B are all selected such that the shell casing feed plunger 28 lags behind the internal guide member 32 as the internal guide member 32 moves in the direction toward the opening 20A of the guide channel 20 and such that the shell casing feed plunger 28 leads the internal guide member 32 as the internal guide member 32 moves in the direction toward the terminal end 20B of the guide channel 20, as sequentially illustrated in FIGS. 4A and 4B, 5A and 5B, 6A and 6B, and 7A and 7B.

In some embodiments, the apparatus 10 includes one or more shell casing positioning and/or guide structures. As one example, a shell casing positioning structure 60 may be included in some embodiments to facilitate positioning of shell casings 70 in the punch zone 16E of the shell casing feed channel 16 (see, e.g., FIG. 4B) to ensure that the spent primer carried by the shell casing 70** is axially aligned with the punch end 30B of the punch plunger. In one example embodiment, the shell casing positioning structure 60 may be provided in the form of a spring clip having a plate 62A mountable to the main body 12 and a resilient tab or finger 62B extending from the plate 62A. Illustratively, the plate 62A may be configured to be affixed to the surface 12A of the main body, e.g., above and/or below the slot 14A, via one or more fixation members 62 configured to engage one or more corresponding bores 68A defined in the front surface 12A of the main body 12**.

Figure 4C:
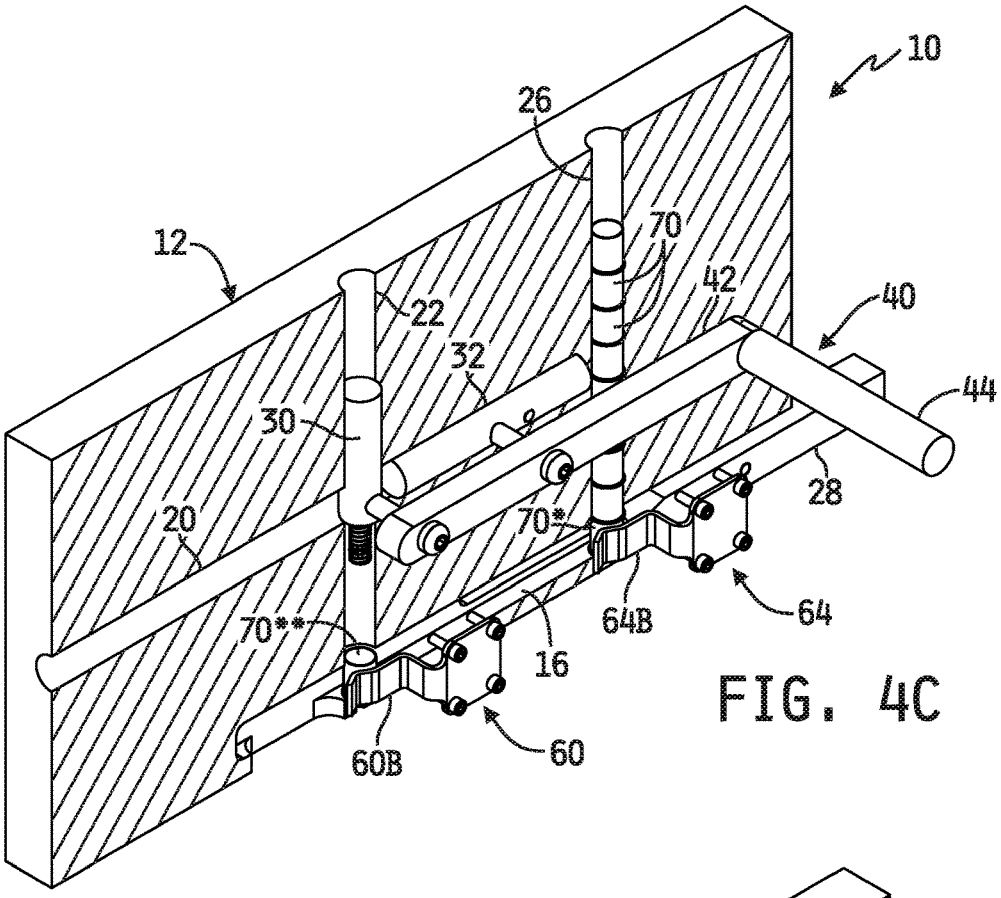
FIG. 4C is a cutaway perspective view of the apparatus otherwise identical to FIG. 4A but with the spring clips of FIGS. 1 and 2 included to demonstrate operation thereof.

In any case, with the plate 62A so mounted to the main body 12, the tab or finger 62B illustratively extends into the slot 14A and at least partially into the channel 16 at or near the punch zone 16E as illustrated in FIG. 4C. In embodiments which include it, the tab or finger 62B of the shell casing positioning structure 60 at least partially extends into the channel 16 at or adjacent to the punch zone 16E and is positioned to prevent or block the shell casing 70 being moved into the punch zone 16E by the shell casing feed plunger 28 from moving past the punch zone 16E until after processing by the pin plunger 30. Illustratively, the tab or finger 62B has a biasing force which is applied to the shell casing 70** to maintain the shell casing 70** positioned in the punch zone. The next shell casing 70* advanced by the shell casing feed plunger 28 to the punch zone 16E pushes the processed shell casing 70** against the tab or finger 62B with sufficient force to overcome the biasing force of the tab or finger 62B, thus advancing the processed shell casing 70*** toward and into the opening 16C of the channel 16, whereby the opening 16C acts as an ammunition shell casing exit port. The shell casing designation 70*** is used to identify shell casings 70 which have been processed by the apparatus 10** to remove spent primers.

As another example, a shell casing guide structure 64 may be included in some embodiments to facilitate positioning of shell casings 70* entering the shell casing feed channel 16 from the shell casing inlet channel 26 into engagement with the nose 28B of the shell casing feed plunger 28. In one example embodiment, the shell casing guide structure 64 may be provided in the form of another spring clip having a plate 64A mountable to the main body 12 and a resilient tab or finger 64B extending from the plate 64A. Illustratively, the plate 64A may be configured to be affixed to the surface 12A of the main body, e.g., above and/or below the slot 14A, via one or more fixation members 66 configured to engage one or more corresponding bores 68B defined in the front surface 12A of the main body 12. In any case, with the plate 64A so mounted to the main body 12, the tab or finger 64B illustratively extends into the slot 14A and at least partially into the channel 16 at or adjacent to a shell casing feed zone 16F defined for purposes of this disclosure as the portion of the shell casing feed channel 16 which intersects the shell casing inlet channel 26. In this regard, the ammunition shell casing designation 70* is used to identify a shell casing 70 positioned in the shell casing feed zone 16F of the shell casing feed channel 16.

Figure 6C:
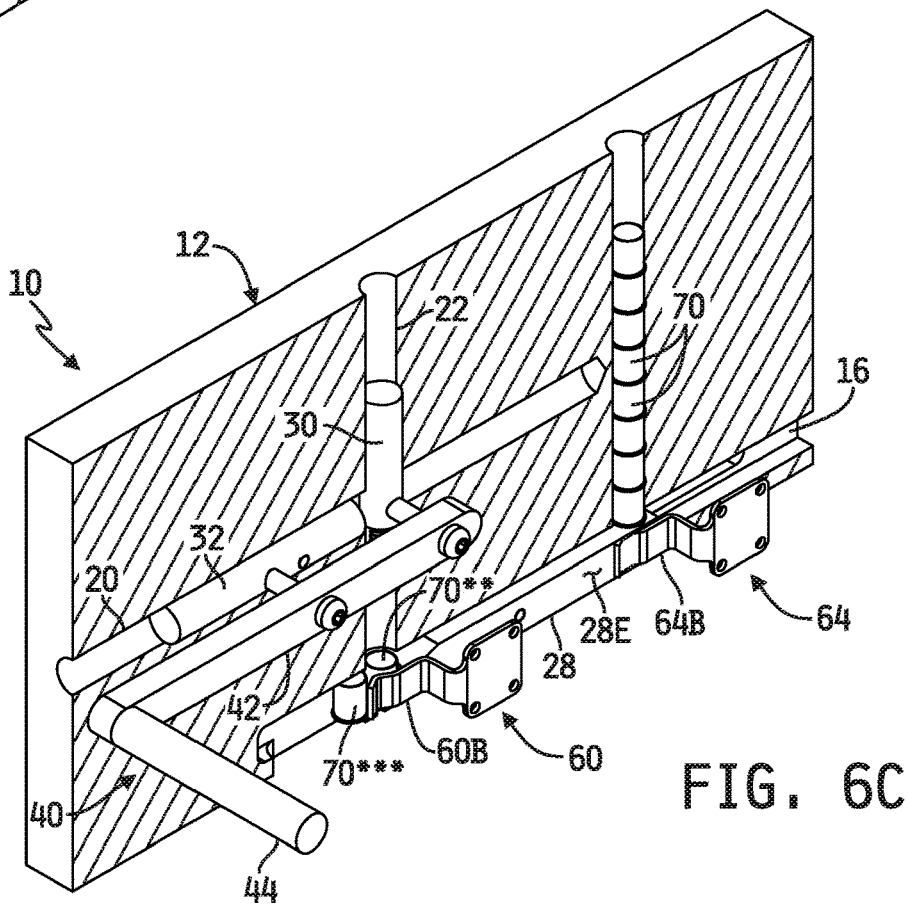
FIG. 6C is a cutaway perspective view of the apparatus similar to FIG. 4C but with the rotatable handle rotated from the first position illustrated in FIG. 4C to the third position.

In embodiments which include it, the tab or finger 64B of the shell casing guide structure 64 at least partially extends into the channel 16 at or adjacent to the feed zone 16E and is positioned to guide the shell casing 70* dropping into the feed zone 16E into engagement with the nose 28B of the shell casing feed plunger 28. More specifically, the tab or finger 64B is illustratively positioned to apply a biasing force acting against the shell casing 70* to force the shell casing 70* against the nose 28 of the shell casing feed plunger 28, i.e., such that the concave arcuate portion of the nose 28 radially engages the outer radial surface of the shell casing 70*, as rotary motion of the handle 40 drives the shell casing feed plunger 28 toward the terminal end 16B of the channel 16. As the shell casing feed plunger 28 is advanced toward the terminal end 16B of the shell casing feed channel 16, the nose 28B of the shell casing feed plunger 28 pushes the tab or finger 64B out of the channel 16 so that the tab or finger 64B rides along the outer surface 28E of the shell casing feed plunger 28 as the plunger 28 continues to advance as illustrated in FIG. 6C. When the shell casing feed plunger is returned to the position illustrated in FIG. 4B, the biasing force of the tab or finger 64B forces the tab or finger 64B back into the channel 16 to guide the next shell casing 70* into engagement with the nose 28B of the plunger 28.

It will be understood that although the plunger 30 and guide member 32, and thus the corresponding channels 22, 20, are illustrated as being cylindrically-shaped, i.e., with circular cross-sections, alternate embodiments are contemplated in which the plunger 30 is not cylindrically-shaped and/or does not have a circular cross-section and/or in which the guide member 32 is not cylindrically-shaped and/or does not have a circular cross-section. Likewise, although the plunger 28 and the corresponding channel 16 are illustrated as having a rectangular or square cross-section, alternate embodiments are contemplated in which the plunger 28 has a non-rectangular or non-square cross-sectional shape.

Figure 9A:
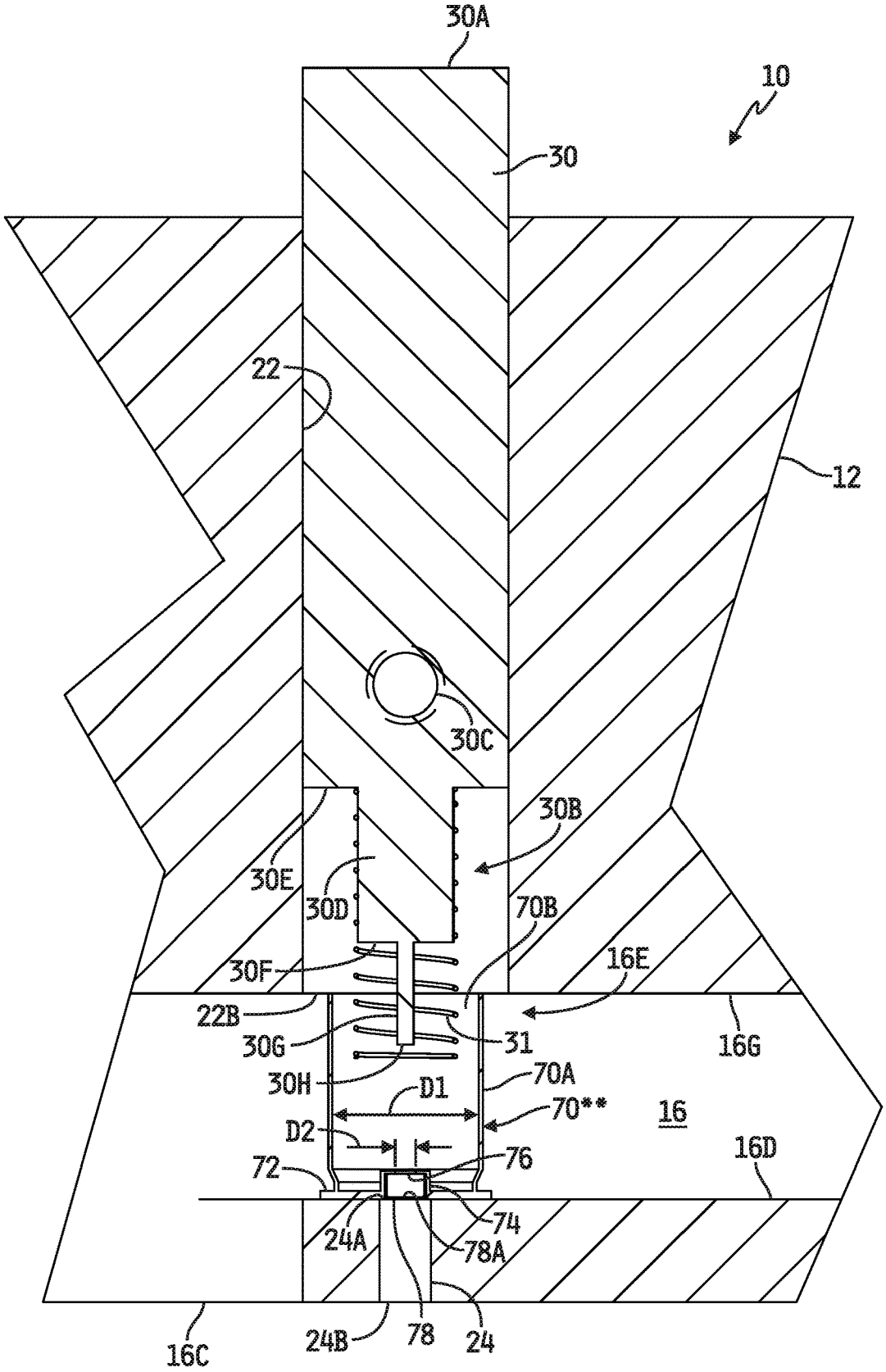
FIGS. 9A-9D are magnified cross-sectional views of the portion B of the apparatus shown in FIG. 7A illustrating successive advancement of the pin plunger into an ammunition shell casing to remove the spent primer therefrom.

Referring briefly to FIG. 9A, some of the features of a conventional spent ammunition shell casing 70 are identified. Ammunition shell casings 70 are generally cylindrical in shape with generally circular cross-sections. In this regard, the shell casing 70** illustrated in FIG. 9A has a cylindrical cartridge case 70A of inner diameter D1 defining a bottom wall 72 of the shell casing 70 at one end thereof, and having an open opposite end 70B which previously engaged a bullet that has since been fired and expelled away from the case 70A. In the illustrated embodiment, the bottom wall 72 of the shell casing 70 includes a rim which extends about the periphery of the cartridge case 70A, although in alternate embodiments the rim may be flush with the outer periphery of the cartridge case 70A or be recessed relative to the outer periphery of the case 70A. The bottom wall 72 defines a primer bore 74 which extends axially therein (and also axially into the cartridge case 70A, and the primer bore 74 opens to the inner portion of the cartridge case 70A via a flash hole 76. As most clearly shown in FIGS. 9A and 9D, the primer bore 74 is open to the bottom wall 72 and includes a cylindrical wall which extends into the cartridge case 70A to a primer bore floor which defines the flash hole 76 therethrough, wherein the flash hole 76 is axially aligned with the primer bore 74 and the primer bore 74 is axially aligned with the cartridge case 70A such that a longitudinal axis extends centrally through each of the case 70A, the primer bore 74 and the flash hole 76. In the illustrated embodiment, the primer bore 74 has an inner diameter D5, and the flash hole 76 has a diameter D2, wherein D5<D2<D1. A now-spent primer 78 is mounted in the primer bore 74. The primer 78 has an open end adjacent to the flash hole 76 and a floor 78A opposite the open end that is illustratively flush with the outer surface of the bottom wall 72 of the shell casing 70. In other shell casings 70, the floor 78A of the primer 78 may be recessed relative to, or proud of, the outer surface of the bottom wall 72. Illustratively, the primer bore 74 and, the flash hole 76 and the primer 78 are all circular in cross-section, and the primer 78 has an outer diameter approximately equal to, or slightly greater than, the inner diameter D5 of the primer bore 74 such that the primer 78 is secured to and within the primer bore 74** with an interference or friction fit as is conventional.

The inner diameter D1 of the cartridge case 70A may illustratively range between approximately 0.22 inches (5.6 mm) and 0.5 inches (12.7 mm), although it will be understood that other shell cartridge cases 70A that may be processed by the apparatus 10 may have inner diameters D1 outside of this example range. The height of the cartridge case 70A between the top edge of the open end 70B and the bottom surface of the rim 72 may illustratively range between 0.68 inches (17.3 mm) and 3.91 inches (99 mm), although it will be understood that other shell cartridge cases 70A that may be processed by the apparatus 10 may have lengths outside of this range. In any case, the height of the shell casing feed channel 16, i.e., the distance between the floor 16D and the ceiling of the channel 16, may vary depending upon the application and will in any case be sized to accommodate cartridge cases 70A of desired height. In some embodiments, a single height of the channel 16 may be suitable to accommodate the heights of a wide range of common cartridge cases, e.g., between 0.38 acp (automatic colt pistol) and 0.45 acp or other suitable range.

Referring now to FIGS. 4A-7B, operation of the apparatus 10 to remove spent primers 78 from ammunition shell casings 70, sometimes referred to as "decapping," will be described in detail. As briefly described above, figure pairs 4A-4B, 5A-5B, 6A-6B and 7A-7B illustrate four sequential static operational states of the apparatus 10 as the rotatable handle 40 is manually driven, via the handle grip 44, in a clockwise direction. Referring specifically to FIGS. 4A and 4B, one or more oriented spent ammunition shell casings 70 are loaded into the shell casing inlet channel 26. Illustratively, the spent shell casings 70 are oriented to stack end-to-end with the rims 72 facing downwardly toward the shell casing feed channel 16. The shell casing inlet channel 26 is illustratively sized to hold a plurality of oriented shell casings 70. In one example embodiment, the shell casing inlet channel 26 is sized to hold 10-12 oriented shell casings 70, although in other embodiments the shell casing inlet channel 26 may be sized to hold any number of oriented shell casings 70. Illustratively, the shell casings 70 may be manually inserted, with proper orientation as just described, into the shell casing inlet channel 26. Alternatively, an external feed apparatus may be operatively attached to the apparatus 10 to continually supply oriented shell casings 70 to the shell casing inlet channel 26, and one example of such an external feed apparatus is illustrated in FIG. 8 to be described below.

Figure 7A:
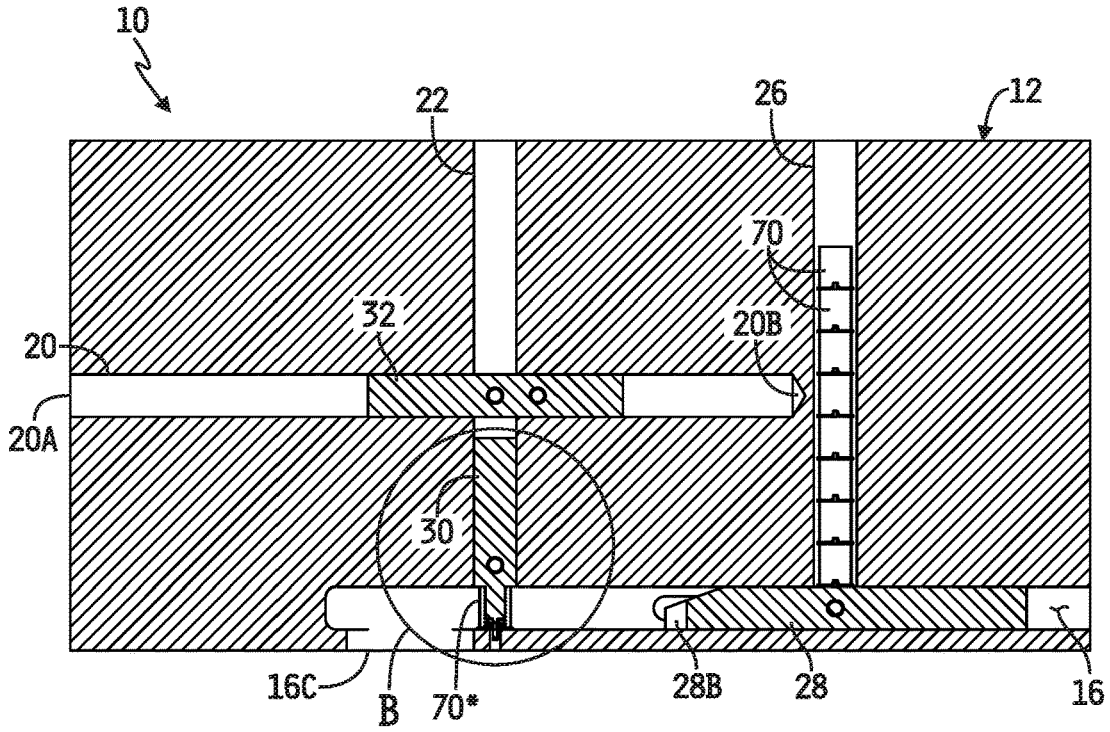
FIG. 7A is a cross-sectional view of the apparatus similar to FIG. 6A but showing operation of the apparatus with the rotatable handle rotated in a clockwise direction from the third position illustrated in FIG. 6A to a fourth position.
Figure 7B:
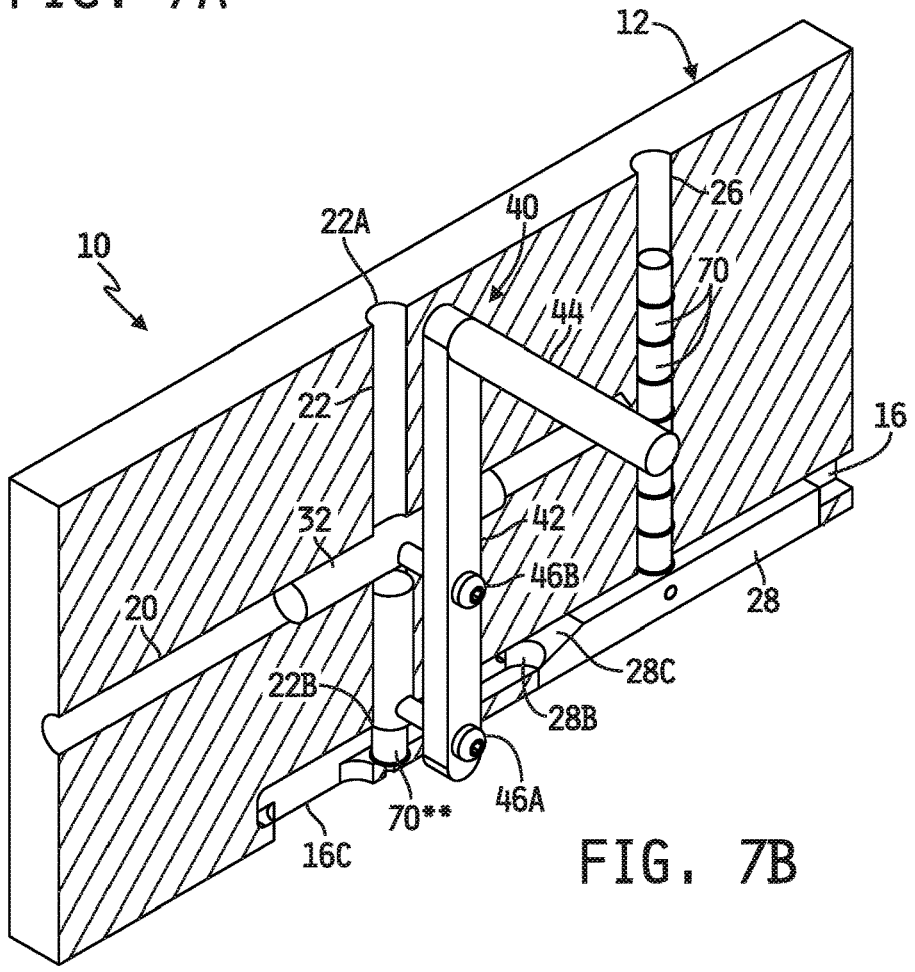
FIG. 7B is a cutaway perspective view of the apparatus similar to FIG. 6B but with the rotatable handle rotated from the third position illustrated in FIG. 6B to the fourth position.
Figure 8:
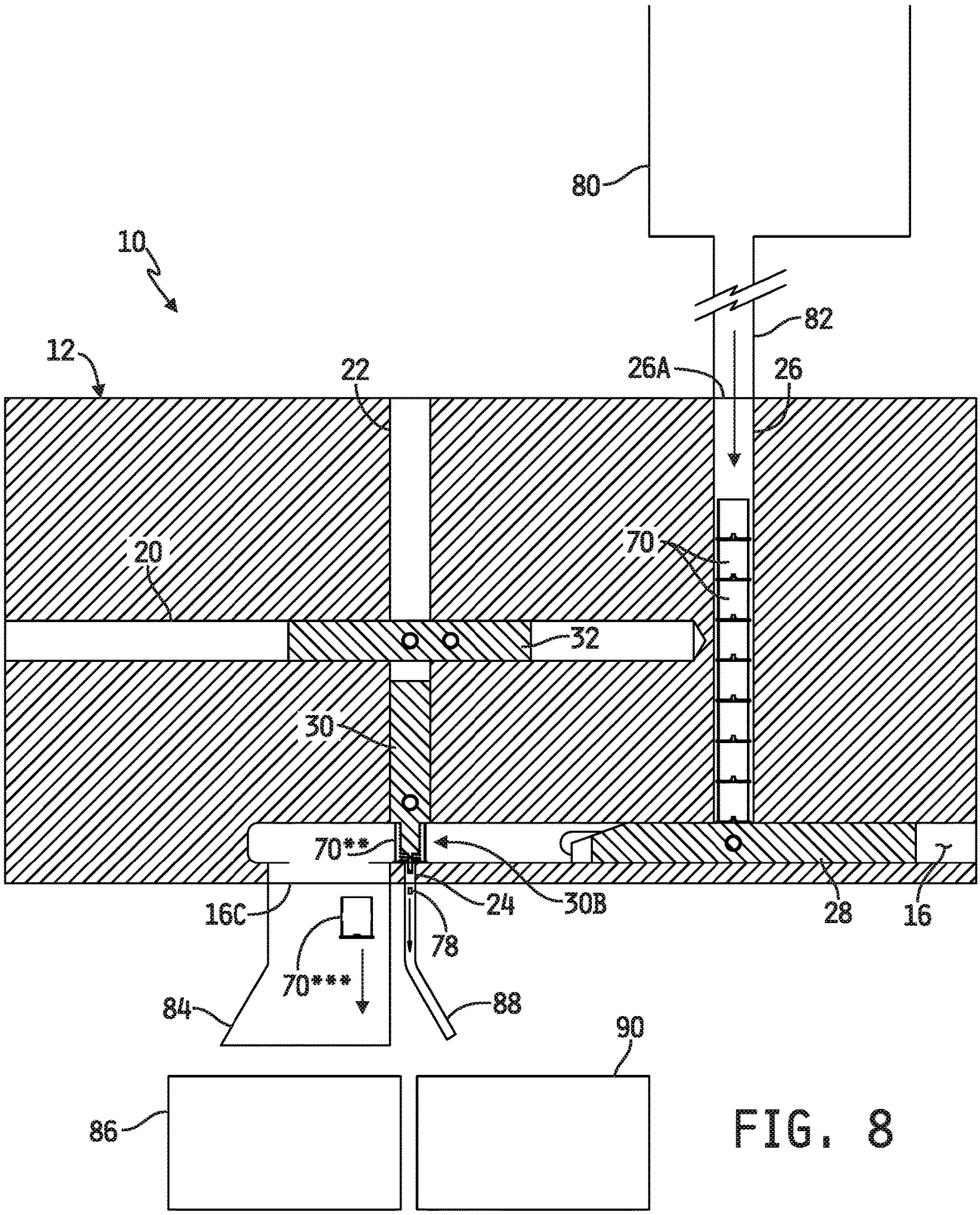
FIG. 8 is a cross-sectional view of the apparatus similar to FIG. 7A illustrating an embodiment of a feeding device for continuously feeding oriented ammunition shell casings with spent primers to the apparatus and illustrating embodiments of parts exit funnels and collection bins for separating and collecting the processed ammunition shell casings and spent primers removed therefrom.

As the handle 40 is rotated in the clockwise direction from the 12 o'clock position illustrated in FIGS. 7A, 7B to the 3 o'clock position illustrated in FIGS. 4A, 4B, the guide members 32 and 48 cooperatively drive the shell casing feed plunger 28 toward and through the opening 16A of the shell casing feed channel 16. As the nose 28B of the plunger 28 moves under and then past the opening 28B of the shell casing inlet channel 26, the rim 72 of the next shell casing 70 to be processed is guided by the sloped surface 28C of the plunger 28 toward the floor 16D of the shell casing feed channel 16. As the nose 28B of the plunger 28 clears the bottom 26B of the channel 26, the shell 70* drops into the shell casing feed zone 16F. Continued rotation of the handle 40 past the 3 o'clock position causes the guide members 32, 48, and thus the shell casing feed plunger 28, to reverse directions and be driven toward the pin plunger channel 22. As this occurs, the concave surface of the nose 28B of the plunger 28 radially engages the outer surface of the shell casing 70* positioned in the shell casing feed zone 16F and begins driving the shell casing 70* toward the terminal end 16B of the channel 16. In embodiments which include the shell casing guide structure 64, the biasing force of the tab or finger 64B of the shell casing guide structure 64 forces the shell casing 70* into contact with the nose 28B of the plunger 28 as illustrated in FIG. 4C, thereby facilitating seating of the shell casing 70* within the concave, arcuate portion of the nose 28B.

Figure 5A:
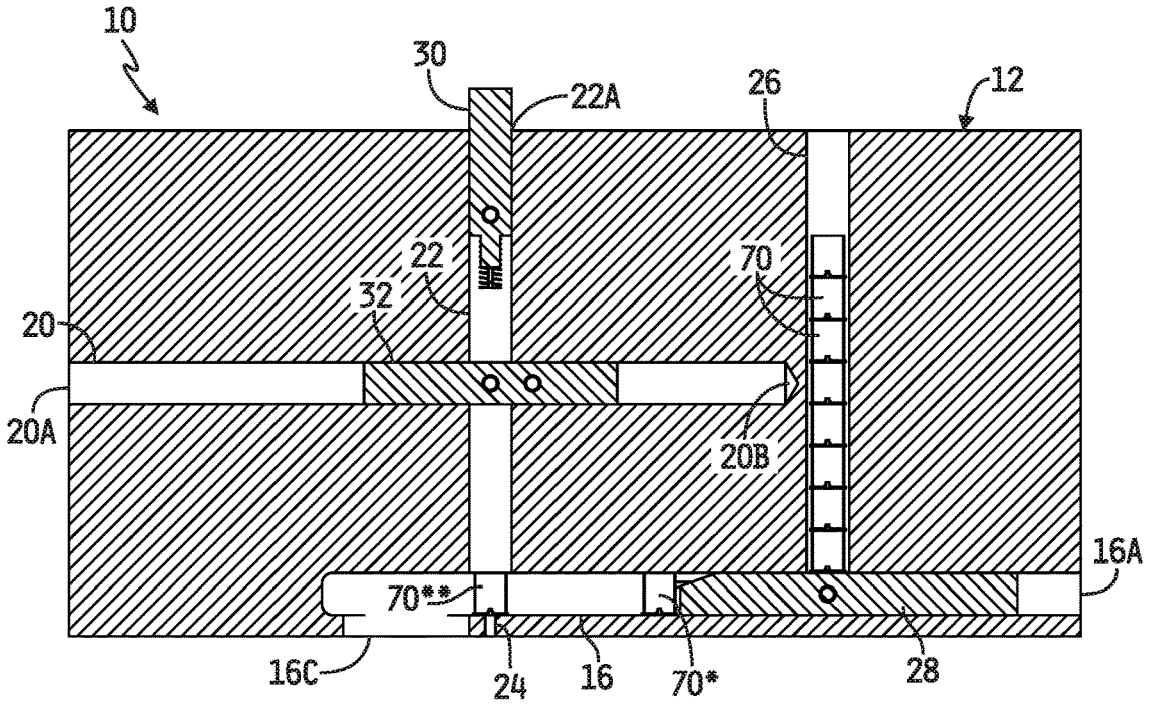
FIG. 5A is a cross-sectional view of the apparatus similar to FIG. 4A but showing operation of the apparatus with the rotatable handle rotated in a clockwise direction from the first position illustrated in FIG. 4A to a second position.
Figure 5B:
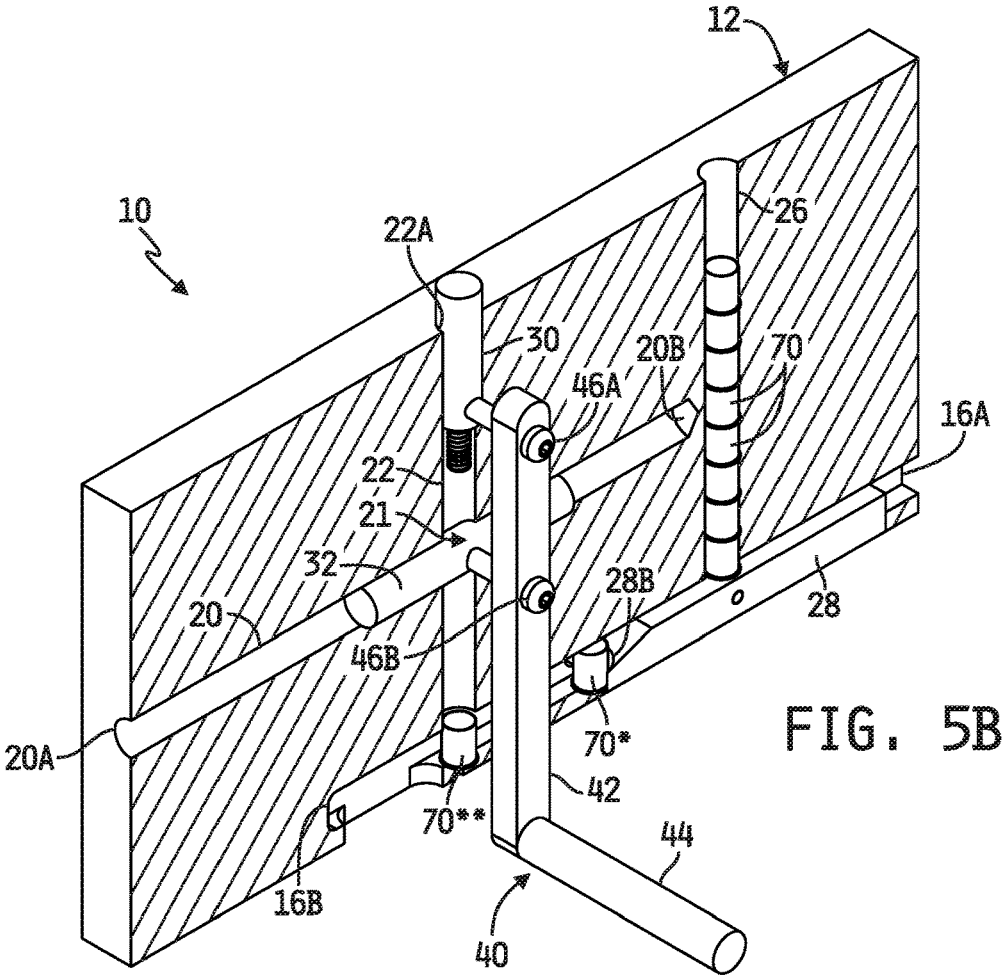
FIG. 5B is a cutaway perspective view of the apparatus similar to FIG. 4B but with the rotatable handle rotated from the first position illustrated in FIG. 4B to the second position.

As the handle 40 is rotated clockwise past the 3 o'clock position illustrated in FIGS. 4A, 4B, the body of the plunger 28 moves under the channel 26, thereby blocking the opening 26B of the shell casing feed channel 26 as illustrated in FIGS. 5A, 5B with the handle 40 rotated to the 6 o'clock position. As illustrated in FIGS. 5A, 5B, the shell casing feed plunger 28 is advancing the spent shell casing 70* toward the pin plunger channel 22 as the pin plunger 30 reaches its zenith within the pin plunger channel 22.

Figure 6A:
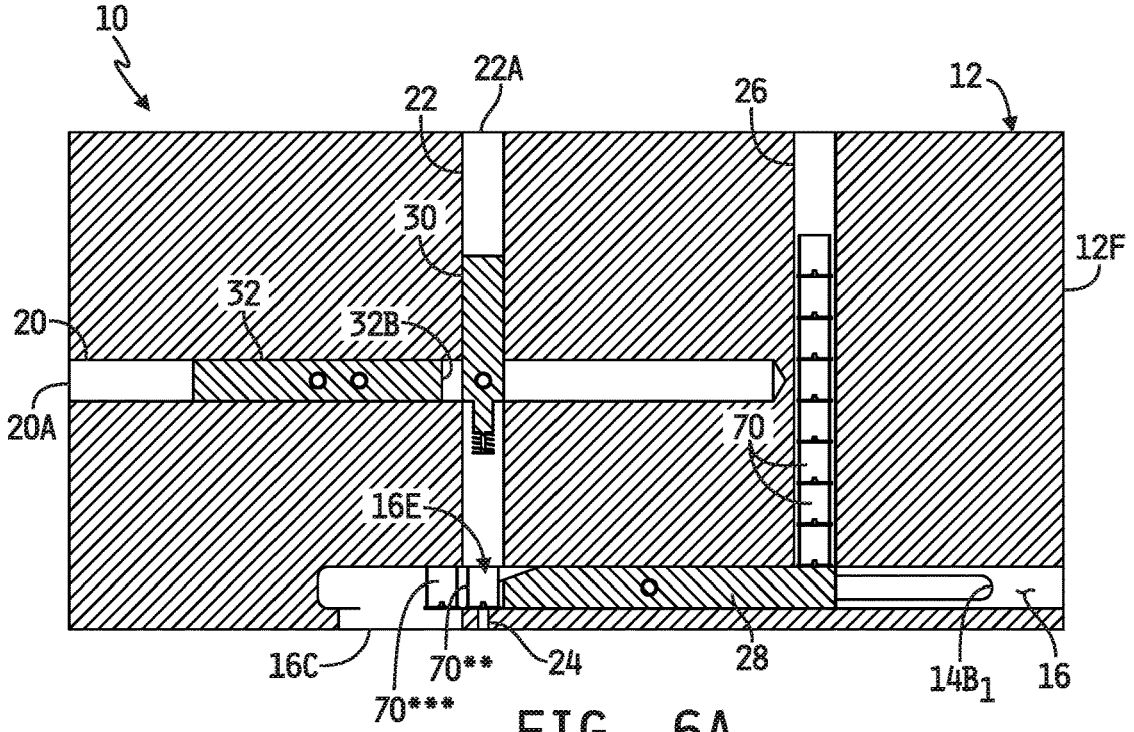
FIG. 6A is a cross-sectional view of the apparatus similar to FIG. 5A but showing operation of the apparatus with the rotatable handle rotated in a clockwise direction from the second position illustrated in FIG. 5A to a third position.
Figure 6B:
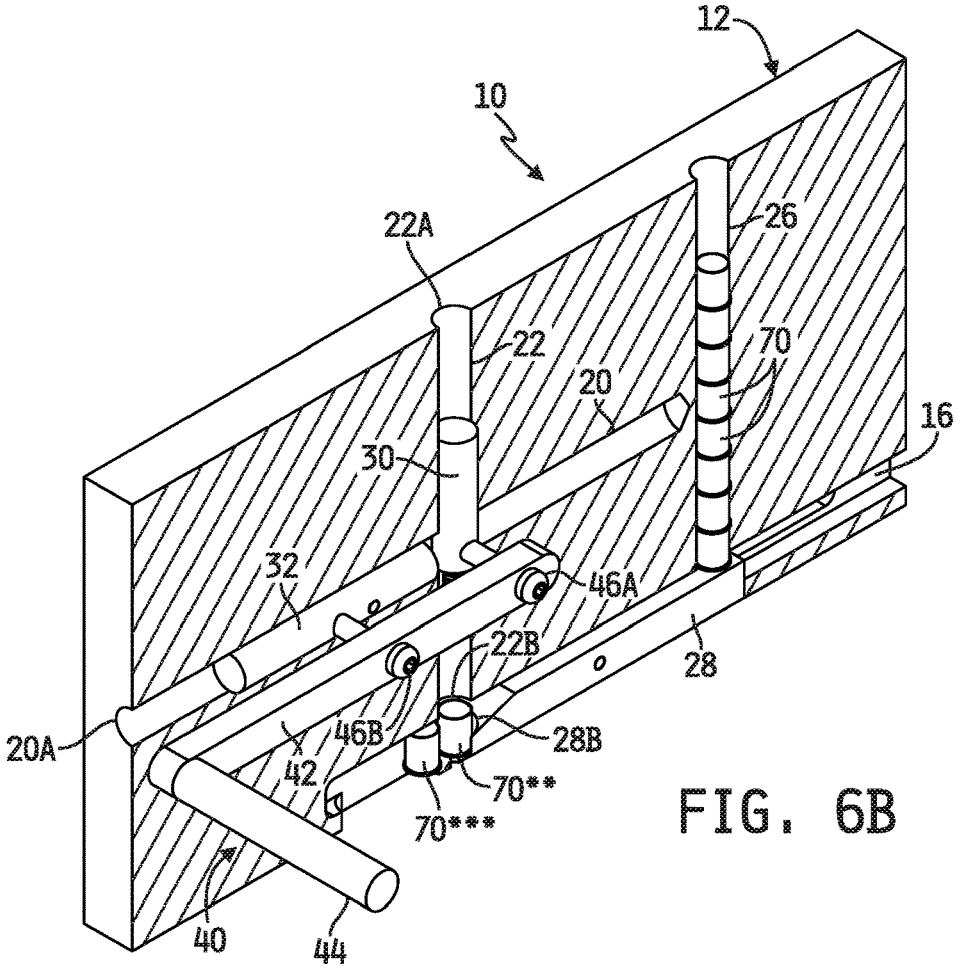
FIG. 6B is a cutaway perspective view of the apparatus similar to FIG. 5B but with the rotatable handle rotated from the second position illustrated in FIG. 5B to the third position.

As the handle 40 is rotated clockwise past the 6 o'clock position illustrated in FIGS. 5A, 5B to the 9 o'clock position illustrated in FIGS. 6A, 6B, the shell casing feed plunger 28 reaches the end of its extension in the direction toward the pin plunger channel 22 where the nose 28B of the shell casing feed plunger 28 places the spent shell casing 70 in the punch zone 16E of the shell casing feed channel 16 as the pin plunger 30 is being driven downwardly toward the spent shell casing 70. In embodiments which include the shell casing positioning structure 60, the tab or finger 62B blocks further movement of the shell casing 70** along the channel 16 toward the terminal end 15B thereof as illustrated by example in FIG. 6C, thus facilitating positioning of the shell casing 70** in the punch zone 16E of the channel 16. Continued rotary motion of the handle 40 past the 9 o'clock position illustrated in FIGS. 6A, 6B to the 12 o'clock position illustrated in FIGS. 7A, 7B drives the punch end 30B of the pin plunger 30 into the spent shell casing 70** and punches out the spent primer 78 with the punch end 30B. Details of the process of punching out the spent primer 78 are illustrated in FIGS. 9A-9**D and will be described in detail below.

As the shell casing feed plunger 28 reaches the end of its extension in the direction toward the pin plunger channel 22 as illustrated in FIGS. 6A, 6B, the guide member 32 reaches the end of its travel toward the opening 20A of the channel 20. As the rotary motion of the handle 40 then moves from the 9 o'clock position toward the 12 o'clock position, the guide member 32 reverses direction and is driven by the handle 40 back toward the terminal end 20B of the channel 20, thereby also driving the shell casing feed plunger 28 back toward the opening 16A of the shell casing feed channel 16 as illustrated in FIGS. 7A, 7B. As the handle 40 is then rotated clockwise past the 12 o'clock position illustrated in FIGS. 7A, 4B back to the 3 o'clock position illustrated in FIGS. 4A, 4B, the nose 28B of the shell casing feed plunger 28 is moved past the opening 26B of the shell casing feed channel 26 so that another shell casing 70 is loaded from the shell casing inlet channel 26 into the shell casing feed zone 16F of the shell casing feed channel 16 as described above.

Referring now to FIG. 8, the apparatus 10 is shown in the same state as that of FIG. 7A in which a spent primer 78 has just been punched out of the shell casing 70 by the punch end 38B of the pin plunger 30. In the illustrated embodiment, an optional continuous-feed apparatus 80 is shown operatively coupled to the opening 26A of the shell casing inlet channel 26 via an inlet tube 82. The continuous-feed apparatus 80 illustratively holds a supply of many spent shell casings 70 and is operable to continuously feed, e.g., one-by-one, oriented shell casings 70 into the shell casing inlet channel 26 via the inlet tube 82. The continuous-feed apparatus 80** may be provided in any of several different forms, examples of which may include, but are not limited to, a vibratory bowl feeder, a shaker table or bin, or the like.

Also shown in FIG. 8 is an optional shell casing exit chute 84 coupled to the opening 16C in the shell casing feed channel 16. The shell casing exit chute 84 is illustratively operable to direct processed shell casings 70* exiting the apparatus 10 into a shell casing collection container 86. An optional spent primer exit chute 88 is likewise shown coupled to the outlet of the spent primer exit channel 24. The spent primer exit chute 88 is illustratively operable to direct extracted primers 78 exiting the apparatus 10 into a spent primer collection container 90**.

Figure 9B:
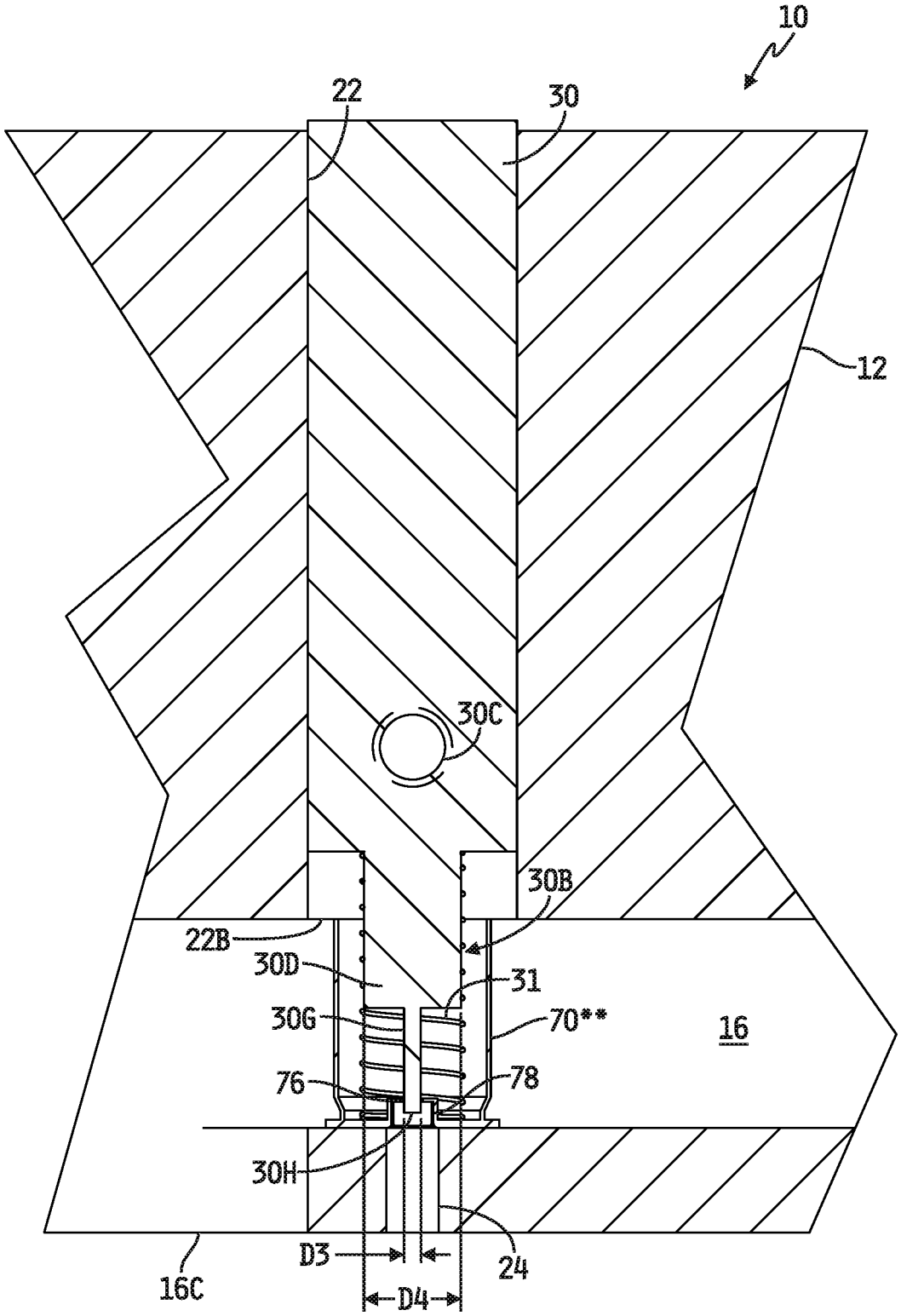
Figure 9C:
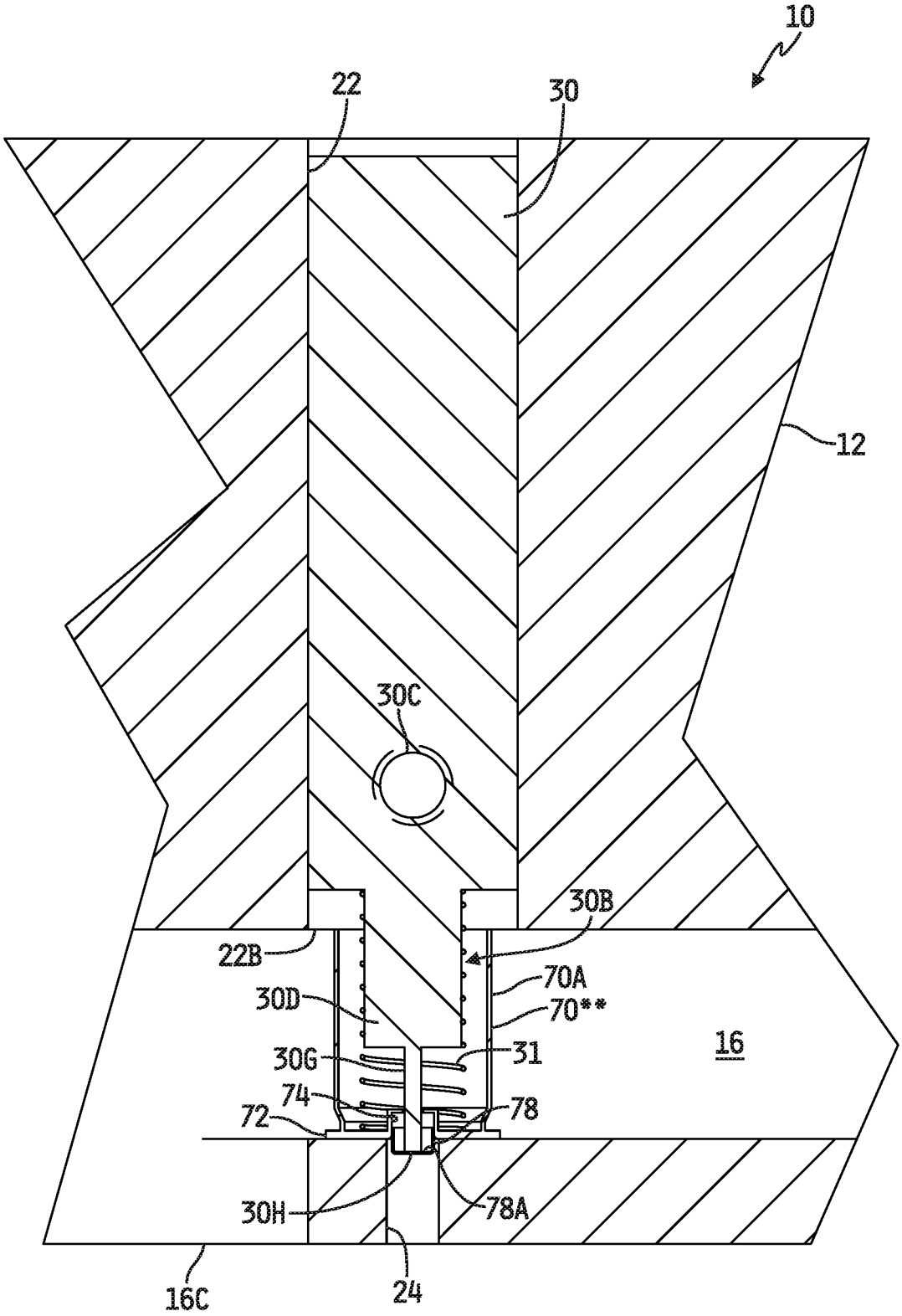

Referring now to FIGS. 9A-9C, magnified views of the region B shown in FIG. 7A are shown which sequentially illustrate operation of the pin plunger 30 to extract, i.e., punch out, spent primers 78 from shell casings 70 positioned in the punch zone 16E of the shell casing feed channel 16 as the handle 40 is rotated through the 12 o'clock position illustrated in FIGS. 7A, 7B. In the illustrated embodiment, the punch end 30B of the pin plunger 30 illustratively includes a cylindrical punch pin guide 30D axially extending downwardly away from an end 30E of the pin plunger 30 opposite the end 30A of the pin plunger 30. Illustratively, the cylindrical punch pin guide 30D has a diameter D4 which is at least slightly less than the inner diameter D1 of the cartridge case 70A of the shell casing 70** so that the punch pin guide 30D may enter the shell casing 70** as the pin plunger 30 descends along the pin plunger channel 22. The punch end 30B of the pin plunger 30 further illustratively includes a cylindrical punch pin 30G axially extending downwardly away from the lower end 30F of the punch pin guide 30F. Illustratively, the cylindrical punch pin 30G has a diameter D3 which is at least slightly less than the diameter D2 of the flash hole 76 defined through the primer bore 74 so that the punch pin 30G may enter the flash hole 76 in order to punch out the spent primer 78. One end of a coil spring 31 is illustratively attached to the punch pin guide 30D, and an opposite of the coil spring extends downwardly from the punch pin guide 30D in a direction parallel with the punch pin 30**G.

Figure 9D:
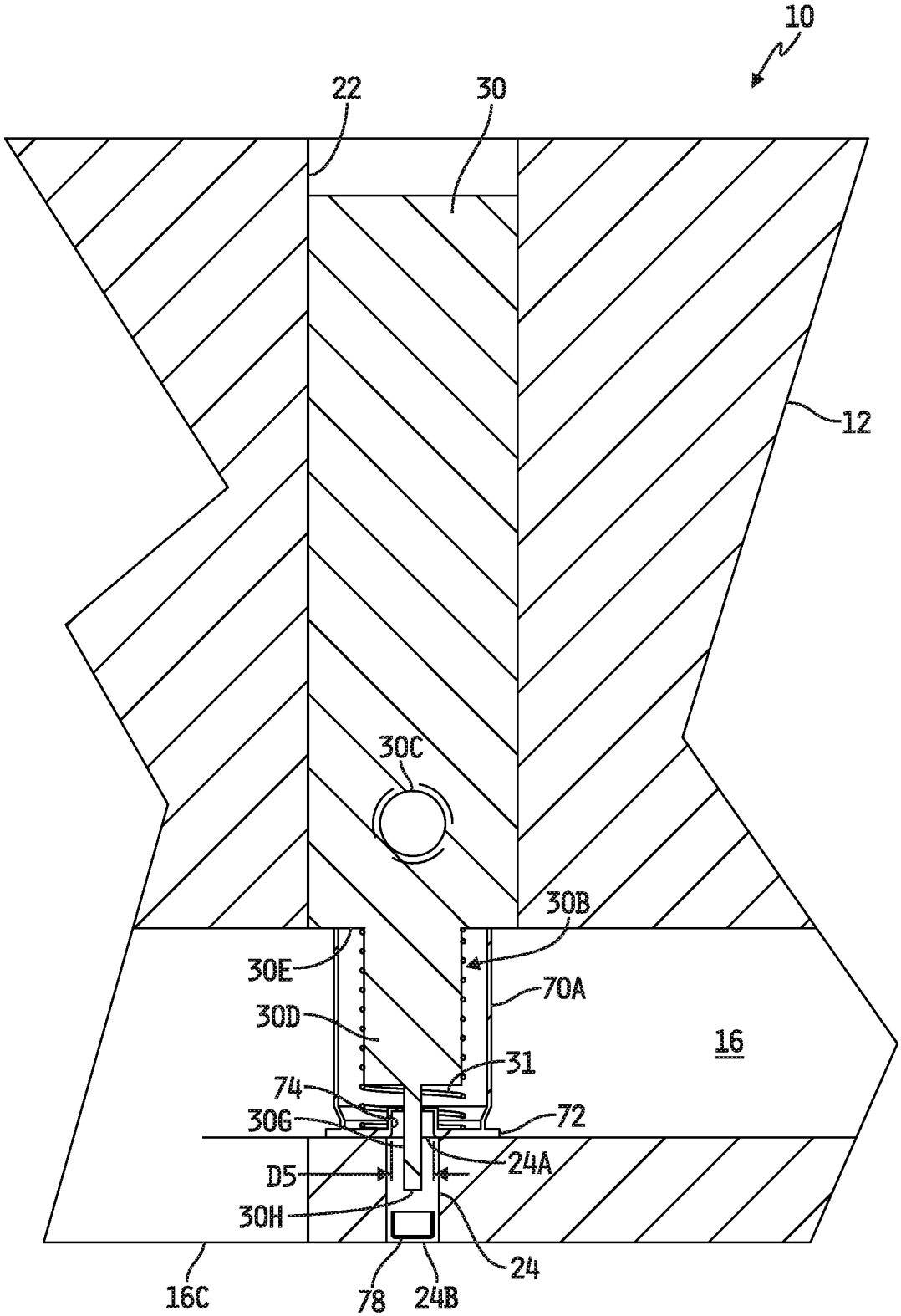

Referring specifically to FIG. 9A, the punch pin guide 30D is axially aligned with the shell casing 70 and the punch pin 30G is axially aligned with the flash hole 76 when the shell casing 70** is properly positioned in the punch zone 16E of the channel 16. As the handle 40 is rotated in the clockwise direction past 12 o'clock, the punch pin 30 and coil spring 31 enter the open shell casing 70** as shown. As the handle 40 is further rotated in the clockwise direction, the punch pin 30G enters the flash hole 76, the punch pin guide 30D enters the open shell casing 70** and the coil spring 31 contacts the inner surface of the rim 72 and begins to compress, as illustrated in FIG. 9B. As the handle 40 is further rotated in the clockwise direction, the end 30H of the punch pin 30G contacts the floor 78A of the spent primer 78 as the punch pin guide 30D extends into the open shell casing 70** and the coil spring 31 compresses further, as illustrated in FIG. 9C. Finally, as the handle 40 is further rotated in the clockwise direction, the continued downward movement of the punch pin 30G in contact with the floor 78A of the spent primer 78 forces the spent primer 78 out of the primer bore 74 and into the spent primer exit channel 24 as the punch pin guide 30D extends further into the open shell casing 70** and the coil spring 31 fully compresses, as illustrated in FIG. 9D. Illustratively, the force of the coil spring 31 acting on the inner surface of the rim 72 acts to force the cartridge case 70A from the punch pin 30G as the pin plunger 30 moves upwardly upon further rotation of the handle 40** in the clockwise direction.

As illustrated in FIGS. 4A-7B, one complete 360-degree rotation of the handle 40 will (i) transport one spent shell casing 70* into alignment with the pin plunger 30, (ii) punch out the spent primer 78 from the aligned shell casing 70 with the punch end 30B of the pin plunger 30, (iii) eject the processed shell casing 70*** and the removed spent primer 78 from the apparatus 10 via the outlet ports 16C, 24 respectively, and (iv) return the shell casing feed plunger 28 to a position which allows the next spent shell casing 70 to be loaded from the shell casing inlet channel 26 into the shell casing feed channel 16. Continuous 360-degree rotation of the handle 40 allows for continuous operation of the device 10 as just described. The rate of decapping by the apparatus 10 depends, in part, on the feed rate of spent shell casings 70 to the apparatus 10 via the shell casing inlet channel 26 and also, in part, on the rotational speed of the handle 40. With a capable bowl type feeder 80, as illustrated in FIG. 8, it is estimated that 2,500 shell casings can be de-capped per hour, compared to a progressive manual type reloading machine (with bowl feeder) at an estimated 500 per hour and a single stage reloading press (no bowl feeder) at an estimated 150-200 per hour. The apparatus 10** will typically be mounted to a stable work surface, e.g., such as a work bench, in the same manner as any conventional reloading press.

While the disclosure has been illustrated and described in detail in the drawings and foregoing description, such an illustration and description is to be considered as exemplary and not restrictive in character, it being understood that only illustrative embodiments have been shown and described and that all changes and modifications consistent with the disclosure and recited claims are desired to be protected. For example, it will be understood that while the guide channel 20 is illustrated in the drawings as being axially disposed perpendicularly or at least approximately perpendicularly to the axial direction of the pin plunger channel 22, such perpendicular arrangement is not strictly required. This perpendicular arrangement illustratively simplifies coupling of the guide member 32 to the shell casing feed plunger 28 via the external guide member 48 such that movement of the shell casing feed plunger 28 is driven by the guide member 32 along a common direction, i.e., along the respective axially parallel channels 16 and 20. In alternate embodiments, the guide channel 20 may be axially disposed non-perpendicularly to the axial direction of the pin plunger channel 22. As long as the connection points of the handle shaft 42 to the pin plunger 30 and the guide member 32 are spaced apart from one another, the rotational motion of the handle assembly 40 will drive the pin plunger 30 and the guide member 32 along the respective channels 22, 20 as described above. In any such non-perpendicular arrangements, however, one or more additional or alternate coupling members may be required between the guide member 32 and the shell casing feed plunger 28 to translate the motion of the guide member 32 along the axial direction of the guide channel 20 to motion of the shell casing feed plunger 28 along a now non-parallel axial direction of the shell casing feed channel 16. As another example, while the guide channel 20 is illustrated in the drawings and described above as being a linear channel, alternate embodiments are contemplated in which the guide channel 20 is non-linear or includes a combination of linear and non-linear sections. Such non-linearity or one or more non-linear sections of the guide channel 20 may facilitate or enhance rotational motion of the handle assembly 40 in some embodiments, and/or may simplify coupling in the guide member 32 to the shell casing feed plunger 28 in embodiments in which the guide channel 20 is not axially parallel to the shell casing feed channel 16. As yet another example, it will be appreciated that while the guide member 32 is illustrated in the drawings and described above as an elongated cylindrical structure, the guide member 32 may alternatively have other shapes, such as a spherical or ovoid shape or any other shape which provides for the coupling thereto of the handle shaft 42 and the external guide member 48 as described above and which will also be driven by the handle assembly 40 along the guide channel 20 without binding or seizing.

What is claimed is:

1. An apparatus for removing spent primers from spent ammunition shell casings, comprising:

a main body defining therein an elongated shell casing feed channel, an elongated pin plunger channel intersecting the shell casing feed channel at a punch zone configured to receive a spent ammunition shell casing, the spent shell casing carrying a spent primer, the spent shell casing fed to the punch zone along the shell casing feed channel, and an elongated guide channel also intersecting the pin plunger channel, a pin plunger, having a punch end, received within the pin plunger channel and configured to be movable along the pin plunger channel such that the punch end extends into the punch zone of the shell casing feed channel, a guide member received within the guide channel and configured to be movable along the guide channel, and a handle assembly operatively coupled to the pin plunger and to the guide member such that rotary motion of the handle assembly about a rotational axis extending perpendicularly through an intersection of the pin plunger channel and the guide channel drives the pin plunger along the pin plunger channel toward and into the punch zone so that, with a spent ammunition shell casing positioned in the punch zone, the punch end of the pin plunger extends into an open end of the shell casing and drives the spent primer from the spent shell casing.

2. The apparatus of claim 1, wherein the guide channel and the shell casing feed channel are both linear channels and parallel with one another, and the pin plunger channel is a linear channel and perpendicular to the guide channel and the shell casing feed channel.

3. The apparatus of claim 1, further comprising:

an elongated shell casing inlet channel also intersecting the shell casing feed channel and configured to feed the spent ammunition shell casing into the shell casing feed channel, and a shell casing feed plunger received within the shell casing feed channel and configured to be movable along the along the shell casing feed channel, wherein the handle assembly is operatively coupled to the shell casing feed plunger such that rotary motion of the handle assembly drives the shell casing feed plunger along the shell casing feed channel toward the punch zone to feed the spent ammunition shell casing received from the shell casing inlet channel into the punch zone.

4. The apparatus of claim 3, wherein the shell casing feed plunger defines a nose end having a concave, arcuate surface configured to engage an outer periphery of the ammunition shell casing.

5. The apparatus of claim 3, wherein rotary motion of the handle assembly moves the shell casing feed plunger along the shell casing feed channel to expose the intersection of the shell casing feed inlet channel and the shell casing feed channel to allow the ammunition shell casing to enter the shell casing feed channel from the shell casing inlet channel.

6. The apparatus of claim 3, wherein the guide channel and the shell casing feed channel are both linear channels and parallel with one another, and the pin plunger channel and the shell casing inlet channel are both linear channels and parallel with one another, and wherein the guide channel and the shell casing feed channel are perpendicular to the pin plunger channel and the shell casing inlet channel.

7. The apparatus of claim 3, further comprising a feed apparatus coupled to the shell casing inlet channel and configured to feed spent ammunition shell casings into the shell casing inlet channel.

8. The apparatus of claim 7, wherein the feed apparatus is a continuous feed apparatus configured to hold a plurality of spent ammunition shell casings and to continuously feed, one-by-one, oriented ammunition shell casings into the shell casing inlet channel.

9. The apparatus of claim 7, wherein the shell casing feed channel defines an ammunition shell casing outlet port adjacent to the punch zone, wherein rotary motion of the handle assembly causes the shell casing feed plunger to continuously feed, one-by-one, each of a plurality of spent ammunition shell casings fed, one-by-one from the shell casing inlet channel into the shell casing feed channel, toward and into the punch zone for removal of the spent primer from the punch zone by the pin plunger, and wherein driving of the shell casing feed plunger by the handle assembly along the shell casing feed channel to feed one of the plurality of spent ammunition shell casings received from the shell casing inlet channel into the punch zone forces a spent shell casing having a spent primer previously removed therefrom by the pin plunger out of the punch zone and into the ammunition shell casing outlet port via which the spent shell casing exits the main body.

10. The apparatus of claim 1, wherein the shell casing feed channel defines a spent primer exit channel in the punch zone opposite the pin plunger channel, and wherein spent primers driven from spent ammunition shell casings by the pin plunger exit the main body via the spent primer exit channel.

11. An apparatus for removing spent primers from spent ammunition shell casings, comprising:

a main body defining therein an elongated shell casing feed channel and an elongated pin plunger channel intersecting the shell casing feed channel at a punch zone configured to receive a spent ammunition shell casing, the spent shell casing carrying a spent primer, the spent shell casing fed to the punch zone along the shell casing feed channel, a pin plunger, having a punch end, received within the pin plunger channel and configured to be movable along the pin plunger channel such that the punch end extends into the punch zone of the shell casing feed channel, a shell casing feed plunger received within the shell casing feed channel and configured to be movable along the shell casing feed channel, and a rotary motion handle assembly operatively coupled to the pin plunger and to the shell casing feed plunger such that rotary motion of the handle assembly drives the shell casing feed plunger along the shell casing feed channel to feed a spent ammunition shell casing into the punch zone and to drive the pin plunger along the pin plunger channel toward and into the punch zone so that, with a spent ammunition shell casing positioned in the punch zone, the punch end of the pin plunger extends into an open end of the shell casing and drives the spent primer from the shell casing.

12. The apparatus of claim 11, wherein the punch end of the pin plunger defines a punch pin guide having an outer diameter less than an inner diameter of the shell casing such that driving of the pin plunger toward and into the punch zone causes the punch pin guide to enter the shell casing via the open end thereof.

13. The apparatus of claim 12, wherein the punch end of the pin plunger defines a punch pin extending from the punch pin guide, the punch pin configured to contact and drive the spent primer from the shell casing.

14. The apparatus of claim 13, wherein the punch pin has an outer diameter less than an inner diameter of a flash hole opening to a primer bore of the shell casing in which the spent primer is mounted, such that driving of the pin plunger toward and into the punch zone causes the punch pin to enter the primer bore via the flash hole to contact and drive the spent primer from the primer bore.

15. The apparatus of claim 11 further comprising a coil spring extending away from the punch end of the pin plunger, the coil spring configured to compress against a bottom wall of the shell casing as rotation of the handle assembly drives the punch end of the pin plunger into contact with the spent primer, and to force the shell casing away from the pin plunger as further rotation of the handle assembly, after the pin plunger drives the spent primer from the shell casing, drives the pin plunger back out of the shell casing.

16. An apparatus for removing spent primers from spent ammunition shell casings, comprising:

a main body defining therein an elongated shell casing feed channel and an elongated pin plunger channel intersecting the shell casing feed channel at a punch zone configured to receive a spent ammunition shell casing, the spent shell casing carrying a spent primer, the spent shell casing fed to the punch zone along the shell casing feed channel, a pin plunger, having a punch end, received within the pin plunger channel and configured to be movable along the pin plunger channel such that the punch end extends into the punch zone of the shell casing feed channel, a shell casing feed plunger received within the shell casing feed channel and configured to be movable along the shell casing feed channel, and a rotary motion handle assembly operatively coupled to the pin plunger and to the shell casing feed plunger, wherein one complete rotation of the handle assembly drives, in sequence, (i) the shell casing feed plunger along the shell casing feed channel to feed a spent ammunition shell casing in the shell casing feed channel into the punch zone, (ii) the pin plunger along the pin plunger channel toward and into the punch zone so that, with the spent ammunition shell casing positioned in the punch zone, the punch end of the pin plunger extends into an open end of the shell casing and drives the spent primer from the shell casing, (iii) the spent shell casing and the spent primer from the main body via respective outlet ports defined in the shell casing feed channel, and (iv) the shell casing feed plunger to a return position which feeds another ammunition shell casing into the shell casing feed channel.

17. The apparatus of claim 16, further comprising an elongated shell casing inlet channel intersecting the shell casing feed channel and configured to feed the spent ammunition shell casing into the shell casing feed channel, wherein driving of the shell casing feed plunger via rotary motion of the handle assembly to the return position exposes the intersection of the shell casing feed inlet channel and the shell casing feed channel to allow the another ammunition shell casing to enter the shell casing feed channel from the shell casing inlet channel.

18. The apparatus of claim 16, further comprising:

an elongated guide channel also intersecting the pin plunger channel, and a guide member received within the guide channel and configured to be movable along the guide channel, wherein the handle assembly is operatively coupled to the pin plunger and to the guide member such that rotary motion of the handle assembly about a rotational axis extending perpendicularly through an intersection of the pin plunger channel and the guide channel drives the pin plunger along the pin plunger channel, the guide member along the guide channel and the shell casing feed plunger along the shell casing feed channel.

19. The apparatus of claim 18, wherein the shell casing feed channel, the pin plunger channel and the guide channel are all elongated, linear channels, and wherein the shell casing feed plunger and the pin plunger are linear plungers and the guide member is a linear member.

20. The apparatus of claim 19, wherein the shell casing feed channel and the guide channel are parallel with one another, and the pin plunger channel is perpendicular to the shell casing feed channel and the guide channel.

* * * * *